US005578433A

United States Patent [19]

Morishima et al.

[11] Patent Number: 5,578,433

[45] Date of Patent: Nov. 26, 1996

[54] PROCESSING COMPOSITION AND PROCESSING METHOD FOR SILVER HALIDE PHOTOGRAPHIC MATERIALS

[75] Inventors: Shinnichi Morishima; Kazumi Nii, both of Kanagawa, Japan

[73] Assignee: Fuji Photo Film Co., Ltd., Kanagawa, Japan

[21] Appl. No.: 544,021

[22] Filed: Oct. 17, 1995

[30] Foreign Application Priority Data

Oct. 17, 1994 [JP] Japan ..... 6-275530

[51] Int. Cl.[6] ..... G03C 5/305

[52] U.S. Cl. ..... 430/436; 430/440; 430/441; 430/446; 430/483; 430/490

[58] Field of Search ..... 430/264, 265, 430/268, 435, 436, 440, 441, 446, 478, 480, 483, 484, 490

[56] References Cited

U.S. PATENT DOCUMENTS

| | | | |
|---|---|---|---|
| 2,688,549 | 9/1954 | James et al. | 430/480 |
| 3,721,563 | 3/1973 | Fisch et al. | 430/490 |
| 3,826,654 | 7/1974 | Weiss et al. | 430/440 |
| 5,098,819 | 3/1992 | Knapp | 430/436 |
| 5,236,816 | 8/1993 | Purol et al. | 430/492 |
| 5,354,646 | 10/1994 | Kobayashi et al. | 430/484 |
| 5,382,507 | 1/1995 | Shimizu et al. | 430/490 |
| 5,385,811 | 1/1995 | Hirano | 430/446 |

FOREIGN PATENT DOCUMENTS

| | | |
|---|---|---|
| 0531582A1 | 3/1993 | European Pat. Off. . |
| 2284067 | 5/1995 | United Kingdom . |

*Primary Examiner*—Hoa Van Le

*Attorney, Agent, or Firm*—Sughrue, Mion, Zinn, Macpeak & Seas

[57] ABSTRACT

A method of processing a silver halide photographic material with a developer containing a compound represented by formula (A), wherein the developer further contains at least one compound represented by formula (B) or (C):

(A)

(B)

(C)

10 Claims, No Drawings

PROCESSING COMPOSITION AND PROCESSING METHOD FOR SILVER HALIDE PHOTOGRAPHIC MATERIALS

FIELD OF THE INVENTION

The present invention relates to a method of processing silver halide photographic materials and a developing composition used therein. More particularly, the invention is concerned with a developing composition containing a developing agent other than dihydroxybenzenes and a method of developing black-and-white silver halide photographic materials with the aforesaid developing composition.

BACKGROUND OF THE INVENTION

Generally used black-and-white silver halide photographic materials (e.g., X-ray film, graphic arts film, photographic processing which comprises a developing step using an alkaline developer containing a hydroquinone as a developing agent and a 3-pyrazolidone compound or an aminophenol compound as an auxiliary developing agent, a fixing step and a washing step. In the image formation, it is particularly desired to ensure rapid and consistent developing processing. For the purpose of rapid processing, there is used a highly active developer containing a large quantity of hydroquinone as a developing agent. Therein, a large quantity of sulfite is also contained in order to maintain the stability of the developer to air oxidation.

On the other hand, using reductones represented by ascorbic acid as a black-and-white developing agent is known in U.S. Pat. Nos. 2,688,549, 3,826,654 and 5,098,819, and so on. The developer using reductones as a developing agent is apt to lower its pH through the processing of photographic materials and the deterioration by air oxidation, compared with the hydroquinone developer. As a means taken to prevent the lowering of pH, it is known to raise the buffer concentration in U.S. Pat. No. 5,236,816. However, this means is still unsatisfactory as the art of suppressing the pH change. Further, the method of adding a salicylic acid derivative to an ascorbic acid developer is disclosed in EP-0531582 A1. However, this method cannot ensure sufficient stability of ascorbic acid in the developer, and so it is also unsatisfactory as the art of suppressing the pH change.

SUMMARY OF THE INVENTION

An object of the present invention is to solve a problem of heightening the air oxidation stability of a developer which does not use a dihydroxybenzene developing agent but contains an ascorbic acid or a derivative thereof as a black-and-white developing agent.

Another object of the present invention is to solve a problem of reducing the amount of a developer replenished by heightening the stability of the developer, thereby lightening the load of waste disposal and heightening the economic efficiency of the development-processing.

A further object of the present invention is to provide an image formation method which not only can achieve the above-described objects but also can lessen the generation of black spots (i.e., pepper fog).

The above-described objects are achieved (i) by a method of processing a silver halide photographic material with a developer comprising an ascorbic acid or a derivative thereof represented by the following formula (A), wherein the developer contains at least one compound represented by the following formula (B) or (C); and (ii) by a processing composition which comprises at least one compound represented by the following formula (B) or (C) and a developing agent represented by the following formula (A):

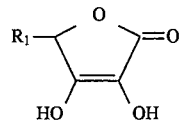

(A)

wherein $R_1$ represents a hydrogen atom, an alkyl group, an aryl group or a heterocyclic group;

$$R_2-\underset{\underset{OH}{|}}{N}-R_3 \qquad (B)$$

wherein $R_2$ and $R_3$ are the same or different, and each represents a hydrogen atom, an alkyl group, an aryl group or a heterocyclic group, excluding the case in which $R_2$ and $R_3$ are both a hydrogen atom; or they are linked to each other to form a heterocyclic ring together with the nitrogen atom;

$$A-X-\underset{\underset{R_4}{|}}{N}-O-Y \qquad (C)$$

wherein A represents a hydrogen atom, an alkyl group, an aryl group, a heterocyclic group, an alkoxy group, an aryloxy group, an amino group, an alkylamino group, an acyl group, a carbamoyl group, a sulfamoyl group, a carboxyl group, a hydroxyamino group or a hydroxyaminocarbonyl group; X represents —C(=O)—, —C(=S)—, —$SO_2$— or —SO—; $R_4$ represents a hydrogen atom, an alkyl group or an aryl group; and Y represents a hydrogen atom or a group capable of being converted into a hydrogen atom by hydrolysis.

DETAILED DESCRIPTION OF THE INVENTION

Ascorbic acids and their derivatives represented by formula (A) are described below in detail.

The alkyl group represented by $R_1$ in formula (A) is a straight-chain, branched or cyclic alkyl group; the aryl group represented by $R_1$ is, e.g., a phenyl or naphthyl group; and the heterocyclic group represented by $R_1$ is a 5- to 6-membered heterocyclic group constituted of carbon, nitrogen, oxygen and/or sulfur atoms, with specific examples including a furyl group, a benzofuryl group, a pyranyl group, a pyrrolyl group, an imidazolyl group, a pyrazolyl group, a triazolyl group, a pyridyl group, a pyrimidyl group, a pyridazyl group, a thienyl group, an isothiazolyl group and so on. These groups each may have one or more of a substituent group. Specific examples of such a substituent include an alkyl group, an alkenyl group, an aryl group, a halogen atom, a nitro group, a mercapto group, a hydroxy group, an alkoxy group, an aryloxy group, an alkylthio group, an arylthio group, an acyloxy group, an amino group, an alkylamino group, a carbonamido group, a sulfonamido group, an ureido group, an acyl group, an oxycarbonyl group, a carbamoyl group, a sulfinyloxy group, a carboxyl (including a carboxylate) group, a sulfo (including a sulfonate) group, a hydroxyamino group and a hydrazino group.

The substituents cited above are described in more detail. Examples of the alkyl group include straight-chain, branched and cyclic alkyl groups each having 1 to 16 carbon atoms, preferably 1 to 6 carbon atoms, which each may be substituted with a substituent instanced as the substituent of $R_1$. Specific examples of such an alkyl group include methyl, ethyl, propyl, isopropyl, butyl, t-butyl, cyclohexyl and hydroxymethyl. Examples of the alkenyl group include straight-chain and branched alkenyl groups each having 2 to 16 carbon atoms, preferably 2 to 6 carbon atoms, which each may be substituted with a substituent instanced as the substituent of $R_1$. Specific examples of such an alkenyl group include ethinyl, propenyl, 3-butenyl and 4-hydroxy-3-butenyl. Example of the aryl group include an aryl group having 6 to 10 carbon atoms, which may be substituted with a substituent instanced as the substituent of $R_1$. Specific examples of such an aryl group include phenyl, naphthyl and p-methylphenyl. Examples of the alkoxy group include an alkoxy group having 1 to 19 carbon atoms, preferably 1 to 8 carbon atoms, which may be substituted with a substituent instanced as the substituent of $R_1$. Specific examples of such an alkoxy group include methoxy, ethoxy, propoxy, butoxy, pentyloxy, hexyloxy, octyloxy and 2-methoxyethoxy. Examples of the aryloxy group include an aryloxy group having 6 to 10 carbon atoms, which may be substituted with a substituent instanced as the substituent of $R_1$. Specific examples of such an aryloxy group include phenoxy, p-hydroxyphenoxy, 3,4-dihydroxyphenoxy, o-carboxyphenoxy and o-sulfophenoxy. Examples of the alkylthio group include an alkylthio group having 1 to 16 carbon atoms, preferably 1 to 8 carbon atoms, which may be substituted with a substituent instanced as the substituent of $R_1$. Specific examples of such an alkylthio group include methylthio and octylthio. Examples of the arylthio group include an arylthio group having 6 to 10 carbon atoms, which may be substituted with a substituent instanced as the substituent of $R_1$. Specific examples of such an arylthio group include phenylthio, 4-hydroxyphenylthio, 4-methoxyphenylthio and 4-butoxyphenylthio. Examples of the-acyloxy group include an acyloxy group having 1 to 17 carbon atoms, preferably 1 to 8 carbon atoms, which may be substituted with a substituent instanced as the substituent of $R_1$. Specific examples of such an acyloxy group include acetoxy, propanoyloxy, butanoyloxy, octanoyloxy, carboxyacetoxy and 3-sulfopropanoyloxy. Examples of the alkylamino group includes those containing 1 to 6 carbon atoms, such as methylamino, dimethylamino, diethylamino, etc. The carbonamido group includes those containing 1 to 6 carbon atoms, such as acetamido, propionamido, etc. The sulfonamido group includes those containing 1 to 6 carbon atoms, such as methanesulfonamido, etc. The ureido group includes those containing 1 to 6 carbon atoms, such as ureido, methylureido, etc. The acyl group includes those containing 1 to 6 carbon atoms, such as acetyl, benzoyl, etc. The oxycarbonyl group includes those containing 1 to 8 carbon atoms, such as methoxycarbonyl, ethoxycarbonyl, etc. The carbamoyl group includes those containing 1 to 6 carbon atoms, such as carbamoyl, N,N-dimethylcarbamoyl, etc. The sulfinyloxy group includes those containing 1 to 6 carbon atoms, such as methanesulfinyloxy, etc.

These substituent groups each may be further substituted, if possible.

The alkyl group represented by $R_1$ in formula (A) is preferably an alkyl group containing 1 to 6 carbon atoms, including those substituted with a. substituent instanced above as the substituent of $R_1$, and more preferably an alkyl group substituted with a hydroxy group, an alkoxy group, an aryloxy group, an alkylthio group, an arylthio group, an acyloxy group, an amino group, an alkylamino group, an oxycarbonyl group, a carboxyl (including carboxylate) group and a sulfo (including sulfonate) group. Specific examples of such an alkyl group including methyl, ethyl, hydroxymethyl, 1-hydroxyethyl, 1,2-dihydroxyethyl, 1,2-dihydroxypropyl, 1,2,3-trihydroxypropyl, 1,2,3,4-tetrahydroxybutyl, 1,2-dimethoxyethyl, 1,1-dimethoxy-2-hydroxyethyl, 1,2-diethoxyethyl, methoxycarbonylmethyl, 1,2-diacetoxyethyl, hydroxycarboxymethyl, acetoxycarboxymethyl, 1-methylthio-2-hydroxyethyl, 1-phenylthio-2-hydroxymethyl, 1-hydroxy-2-octylthioethyl, 1-hydroxy-2-phenylthioethyl, 1-hydroxy-2-aminoethyl, 1-hydroxy-2-phenoxyethyl and 1-hydroxy-2-sulfoethyl. These groups each may be further substituted, if possible.

The aryl group represented by $R_1$ in formula (A) is preferably an aryl group containing 6 to 10 carbon atoms, including those substituted with a substituent instanced above as the substituent of $R_1$. Examples of such an aryl group include phenyl, p-methylphenyl, anisyl, p-carboxyphenyl and p-sulfonylphenyl.

The heterocyclic group represented by $R_1$ in formula (A) is preferably a furyl group, a pyridyl group or a triazolyl group, including those substituted with a substituent instanced above as the substituent of $R_1$. Examples of such a heterocyclic group include furyl, 5-methylfuryl, benzofuryl, pyridyl, 5-chloropyridyl, 3-carboxypyridyl, 5-sulfopyridyl and 1-phenyltriazolyl.

Particularly preferably, $R_1$ in formula (A) is a hydrogen atom, a methyl group or an ethyl group, which each may be substituted with another substituent. As for the substituent(s) of those groups, a hydroxy group, an alkoxy group and an acyloxy group are examples thereof. Of these substituents, preferred ones are an alkoxy group and an acyloxy group, especially those containing 1 to 8 carbon atoms. Optionally, these substituents may be further substituted with an alkenyl group, an aryl group, a hydroxy group, an alkoxy group, a carboxyl (including carboxylate) group, a sulfo (including sulfonate) group, a hydroxyamino group, a hydrazino group or so on.

Of the compounds represented by formula (A), compounds represented by the following formula (D) are most preferred:

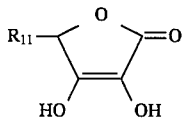

(D)

wherein $R_{11}$ is a group represented by the following formula (E) or (F);

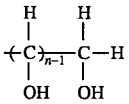

(E)

wherein n is an integer of 1 to 4,

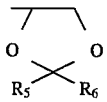

(F)

wherein $R_5$ and $R_6$ are the same or different, and each represents a hydrogen atom, an alkyl group, an aryl group or an alkenyl group; or the alkyl groups represented by $R_5$ and $R_6$ are linked to each other to form a ring structure.

Therein, each of the alkyl group, the aryl group and the alkenyl group include substituted ones. Examples of substituent(s) which those groups can have include an alkyl group, an alkenyl group, an aryl group, a halogen atom, a nitro group, a hydroxy group, an alkoxy group, an acyl group, a carboxyl (including carboxylate) group, a sulfo (including sulfonate) group and a hydroxylamino group.

Each of $R_5$ and $R_6$ in the compounds represented by formula (F) is preferably a hydrogen atom, an alkyl group containing 1 to 7 carbon atoms, an aryl group containing 6 to 10 carbon atoms or an alkenyl group containing 2 to 7 carbon atoms; more preferably a hydrogen atom, an alkyl group containing 1 to 7 carbon atoms or an aryl group containing 6 to 10 carbon atoms; and most preferably a hydrogen atom or an alkyl group containing 1 to 7 carbon atoms. Alkyl groups represented by $R_5$ and $R_6$ may be linked to each other to form a ring structure. Moreover, it is preferable that at least either $R_5$ or $R_6$ is not a hydrogen atom. Those groups may have substituent(s) as cited above. Specific examples of $R_5$ and $R_6$ include a hydrogen atom, a methyl group, an ethyl group, a propyl group, a butyl group, a phenyl group, a chloromethyl group, a methoxyethyl group, a 2-methoxyethyl group, a 1-hydroxyamino-1-methyl-ethyl group, and a 2-carboxyethyl group; and a cyclopentyl or cyclohexyl ring formed by linking alkyl groups represented by $R_5$ and $R_6$ to each other. These groups each may be further substituted, if possible.

The compounds of formula (A) are described in the so-called enol form. Since the isomer of an enol body, or the keto body, is virtually the same compound, the compounds isomeric with the compounds of formula (A) should be construed as being comprised in the scope of the present invention.

The compounds illustrated below are specific examples of the compounds represented by formula (A), and the invention should not be construed as being limited to these exemplified compounds.

A-1

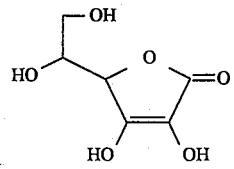

A-2

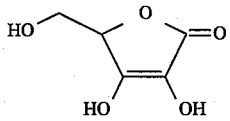

A-3

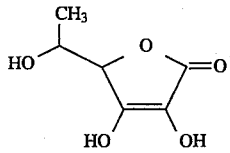

A-4

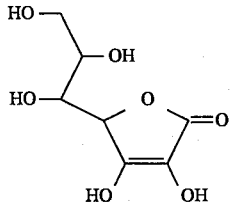

A-5

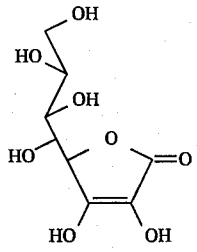

-continued

A-6

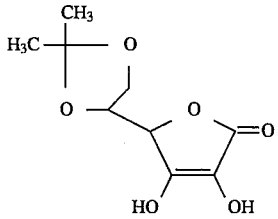

A-7

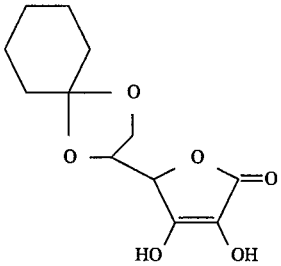

A-8

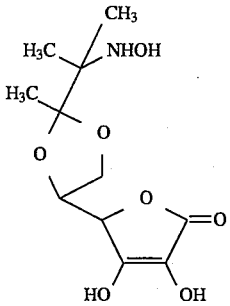

A-9

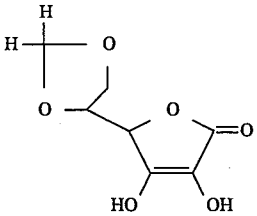

A-10

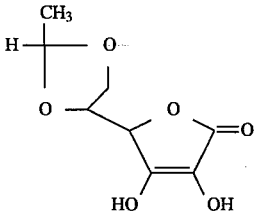

A-11

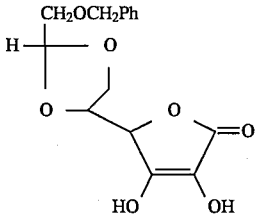

-continued
A-12
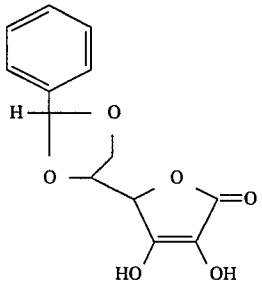
A-13
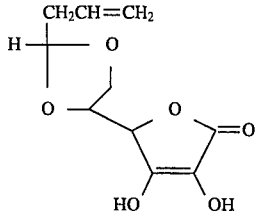
A-14
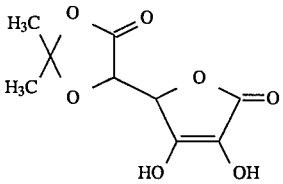
A-15
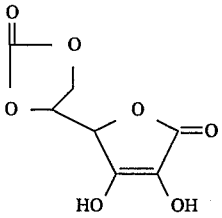
A-16
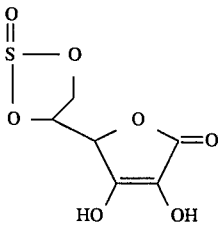
A-17
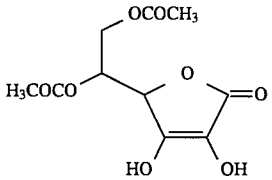
A-18
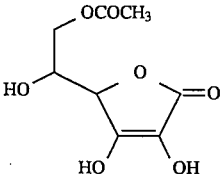
A-19
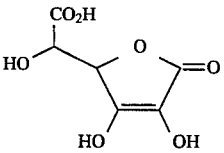
-continued
A-20
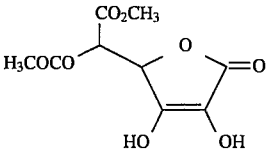
A-21
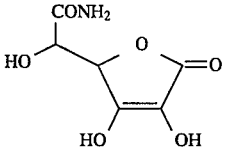
A-22
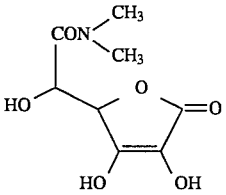
A-23
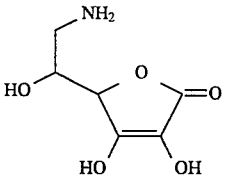
A-24
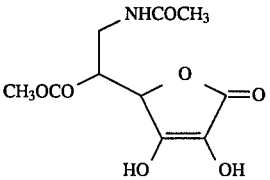
A-25
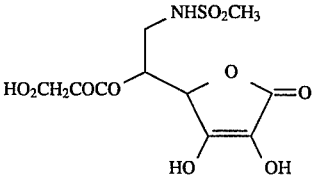
A-26
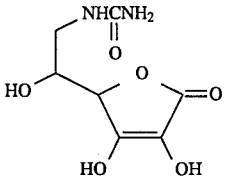
A-27
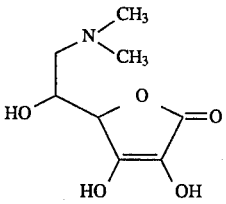
A-28
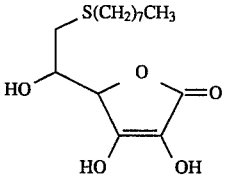

-continued
A-29
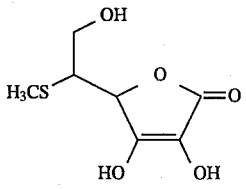
A-30
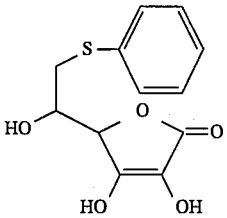
A-31
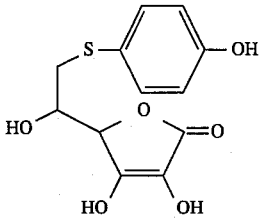
A-32
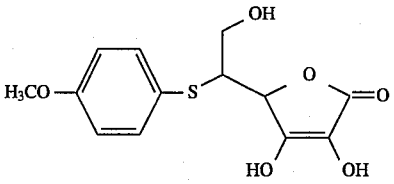
A-33
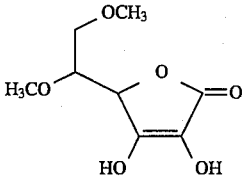
A-34
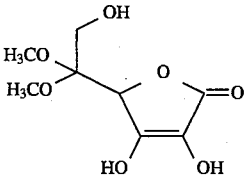
A-35
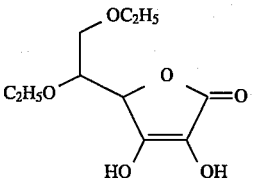
A-36
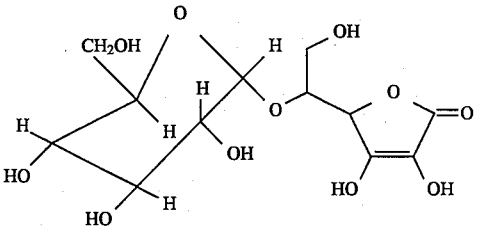
-continued
A-37
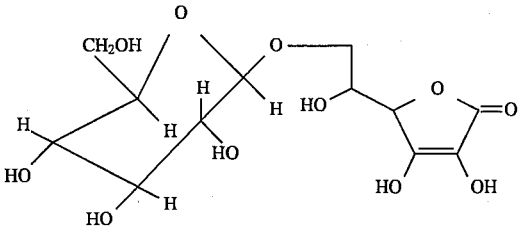
A-38
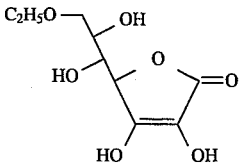
A-39
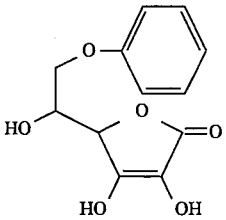
A-40
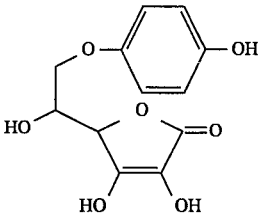
A-41
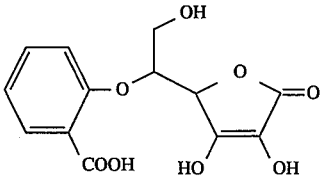
A-42
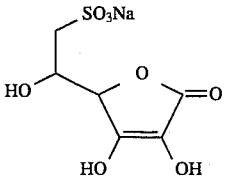
A-43
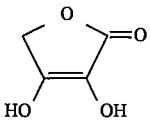
A-44
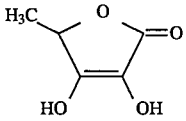
A-45
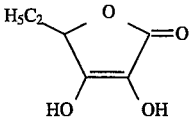

-continued

A-46

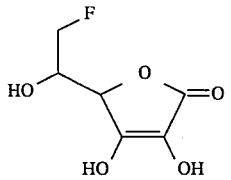

A-47

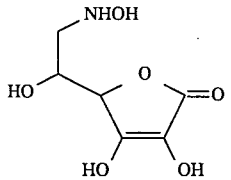

A-48

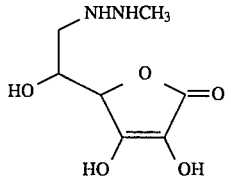

A-49

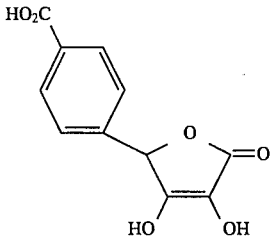

A-50

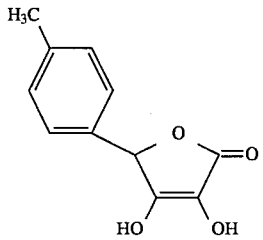

A-51

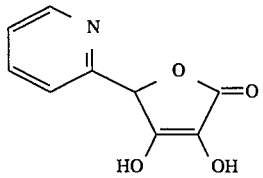

A-52

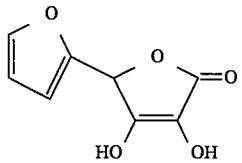

A-53

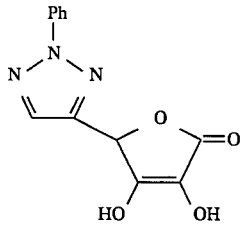

The compounds represented by formula (A) can be synthesized according to general methods as described, e.g., in E. S. H. EL. Ashry, A. Moussad and N. Rashed, *Advances in Heterocyclic Chemistry*, vol. 53, pages 233–302; JP-A-57-188586 (the term "JP-A" as used herein means an "unexamined published Japanese patent application), JP-A-64-45383, JP-A-02-288872, JP-A-04-29985, JP-A-04-364182, JP-A-05-112594; and so on.

The compounds represented by formula (B) are described below in detail.

Examples of the alkyl group represented by $R_2$ or $R_3$ in formula (B) include a straight-chain, branched or cyclic alkyl group, or the alkyl groups of $R_2$ and $R_3$ are linked to each other to form a 5- or 6-membered nitrogen-containing heterocyclic ring together with the nitrogen atom. Examples of the heterocyclic ring formed include a pyrrolidine ring, a piperidine ring, an N-alkylpiperazine ring, a morpholine ring, an indoline ring and a benzotriazole ring. Examples of the aryl group represented by $R_2$ or $R_3$ each include a phenyl group or a naphthyl group, and the heterocyclic group represented thereby is a 5- or 6-membered heterocyclic group constituted of carbon atom(s), nitrogen atom(s), oxygen atom(s) and/or sulfur atom(s), with examples including a furyl group, a pyrrolyl group, an imidazolyl group, a pyrazolyl group, a triazolyl group, a tetrazolyl group, a pyridyl group, a pyrimidinyl group, a pyridazinyl group, a triazinyl group, a thienyl group and a thiazolyl group.

The groups represented by $R_2$ and $R_3$ each may have substituent(s), such as an alkyl group, an aryl group, a halogen atom, a nitro group, a hydroxy group, an alkoxy group, an aryloxy group, an alkylthio group, an arylthio group, an acyloxy group, an amino group, an alkylamino group, a carbonamido group, a sulfonamido group, an oxycarbonylamino group, an ureido group, an acyl group, an oxycarbonyl group, a carbamoyl group, a sulfonyl group, a sulfamoyl group, a carboxyl (including carboxylate) group, a sulfo (including sulfonate) group, a phospho (including phosphate) group, a heterocyclic group, etc.

The substituents for $R_2$ or $R_3$ cited above are described in more detail. Examples of the alkyl group include straight-chain, branched and cyclic alkyl groups containing 1 to 10 carbon atoms, preferably 1 to 5 carbon atoms, which each may be substituted with a substituent instanced as the substituent of $R_2$ and $R_3$. Examples of such an alkyl group include methyl, ethyl, propyl, isopropyl, butyl, t-butyl, cyclohexyl and hydroxymethyl. Examples of the aryl group include an aryl group containing 6 to 10 carbon atoms, which each may be substituted with a substituent instanced as the substituent of $R_2$ and $R_3$. Specific examples of such an aryl group include phenyl, anisyl, p-chlorophenyl and p-carboxyphenyl. Examples of the halogen atom include a fluorine atom, a chlorine atom and a bromine atom. Examples of the alkoxy group include an alkoxy group containing 1 to 10 carbon atoms, preferably 1 to 5 carbon atom, which may be substituted with a substituent instanced as the substituent of $R_2$ and $R_3$. Specific examples of such an alkoxy group include methoxy, ethoxy, propoxy, butoxy and 2-methoxyethoxy. Examples of the aryloxy group include an aryloxy group containing 6 to 10 carbon atoms, (e.g., a phenoxy group). Examples of the alkylthio group include an alkylthio group containing 1 to 10 carbon atoms, preferably 1 to 5 carbon atoms (e.g., methylthio). Examples of the arylthio group include an arylthio group containing 6 to 10 carbon atoms (e.g., phenylthio). Examples of the acyloxy group include an acyloxy group containing 1 to 10 carbon atoms, preferably 1 to 5 carbon atoms (e.g., acetoxy). Examples of the alkylamino group include an alkylamino group containing 1 to 6 carbon atoms (methylamino, dimethylamino, and diethylamino). Examples of the carbonamido group include a carbonamido group containing 1 to 7 carbon atoms (acetamido and benzamido). Examples of the sulfonamido group include a sulfonamido group containing 1 to 6 carbon atoms (e.g.,methanesulfonamido, benzenesulfonamido). Examples of the oxycarbonylamino group include an oxycarbonylamino group containing 1 to 7 carbon atoms (e.g., methoxycarbonylamino and phenoxycarbonylamino). Examples of the ureido group include an ureido group containing 1 to 7 carbon atoms (e.g., ureido, methylureido, and phenylureido). Examples of the acyl group include an acyl group containing 1 to 6 carbon atoms (e.g., acetyl and benzoyl). Examples of the oxycarbonyl group include an oxycarbonyl group containing 1 to 8 carbon atoms (e.g., methoxycarbonyl, and phenoxycarbonyl). Example of the carbamoyl group include a carbamoyl group containing 1 to 6 carbon atoms (e.g., carbamoyl and N,N-diethylcarbamoyl). Examples of the sulfonyl group include a sulfonyl group containing 1 to 8 carbon atoms (e.g., methanesulfonyl and p-toluenesulfonyl). Examples of the sulfamoyl group include a sulfamoyl group containing 1 to 6 carbon atoms (e.g., sulfamoyl, and diethylsulfamoyl). Examples of the heterocyclic group include a 5- to 6-membered heterocyclic group containing as hetero atom(s) nitrogen, oxygen or(and) sulfur atom(s) (e.g., pyridyl, and morphilino).

These substituents may be further substituted, if possible.

Preferred examples of the alkyl group of $R_2$ or $R_3$ in formula (B) include an alkyl group containing 1 to 5 carbon atoms, which may be substituted with a substituent instanced as the substituent of $R_2$ and $R_3$. More preferred examples of the alkyl group include an alkyl group substituted with an aryl group, a hydroxy group, an alkoxy group, an amino group, an alkylamino group, a carbonamido group, a sulfonyl group, a carboxyl (including carboxylate) group, a sulfo (including sulfonate) group, a phospho (including phosphate) group or/and a heterocyclic group. Specific examples of such alkyl groups include methyl, ethyl, butyl, i-propyl, hydroxymethyl, carboxymethyl, sulfomethyl, benzyl, phenylcarboxymethyl, p-methoxyphenylmethyl, p-carboxyphenylmethyl, morpholinomethyl, hydroxyethyl, carboxyethyl, 1,2-dicarboxyethyl, 1-phenyl-2-carboxyethyl, sulfoethyl, methoxyethyl, ethoxyethyl, ethanesulfonylethyl, pyridylethyl, carboxypropyl, sulfopropyl and phosphopropyl. These groups may be further substituted, if possible.

The aryl group represented by $R_2$ or $R_3$ in formula (B) is preferably a phenyl group, which may be substituted with a substituent instanced as the substituent of $R_2$ and $R_3$. Specific examples of such a phenyl group include phenyl, p-methylphenyl, anisyl, p-carboxyphenyl, p-sulfophenyl, 3-carboxy-4-chlorophenyl.

The heterocyclic group represented by $R_2$ or $R_3$ in formula (B) is preferably a pyridyl group, a pyrimidinyl group, a pyridazinyl group, a triazinyl group or a thiazolyl group, which substituted with a substituent instanced as the substituent of $R_2$ and $R_3$. Specific examples of such a heterocyclic group include pyridyl, chloropyridyl, quinolyl, pyrimidinyl, chloropyridazinyl, diethylaminotriazinyl, 3,5-dimethoxytriazinyl, benzothiazolyl.

Particularly preferably, $R_2$ and $R_3$ are each a hydrogen atom or an alkyl group containing 1 to 5 carbon atoms, so far as both of them is not a hydrogen atom. The case in which $R_2$ is a hydrogen atom and $R_3$ is an alkyl group is the best combination. Such an alkyl group includes those substituted with another subsituent. As for the substituent with which the alkyl group may be substituted, there are instanced an aryl group, a hydroxy group, an alkoxy group, an amino group, an alkylamino group, a carbonamido group, a sulfonyl group, a carboxyl (including carboxylate) group, a sulfo (including sulfonate) group, a phospho (including phosphate) group and a heterocyclic group; preferably an aryl group, a hydroxy group, a carboxyl group, a sulfo group and a phospho group. These groups may be further substituted, if possible, with a substituent instanced as the substituent of $R_2$ and $R_3$.

Specific examples of the compound represented by formula (B) are illustrated below. However, the invention should not be construed as being limited to the compounds exemplified below.

$HONHCH_3$ B-1

$HONHCH_2CO_2H$ B-2

$HONHC_2H_4CO_2H$ B-3

$HONHC_3H_6CO_2H$ B-4

$HONHC_3H_6SO_3H$ B-5

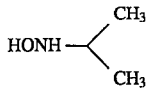

B-6

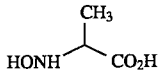

B-7

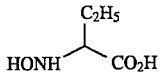

B-8

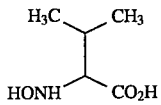

B-9

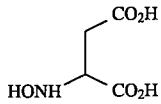

B-10

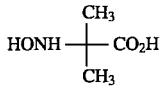

B-11

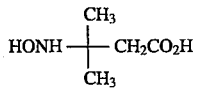

B-12

$HONHC_2H_4SO_3H$ B-13

$HONHC_3H_6PO_3H_2$ B-14

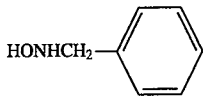

B-15

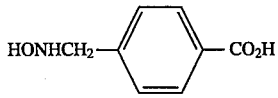

B-16

-continued
B-17
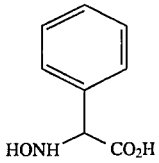
B-18
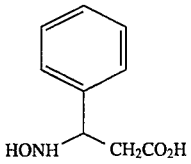
B-19
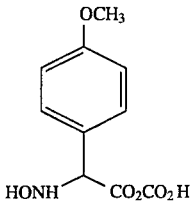
B-20
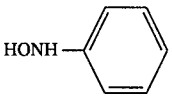
B-21
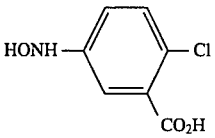
B-22
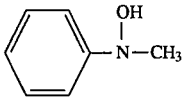
B-23
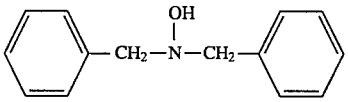
B-24
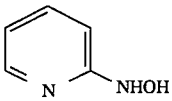
B-25
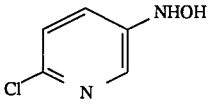
B-26
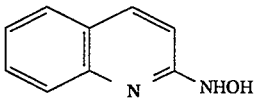
B-27
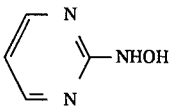
B-28
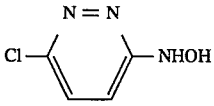
-continued
B-29
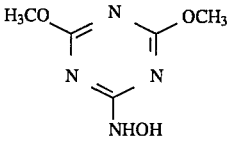
B-30
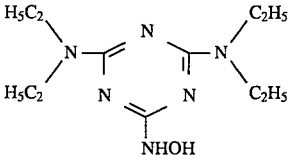
B-31
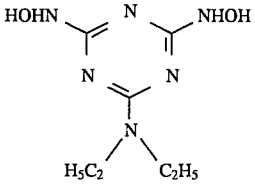
B-32
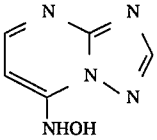
B-33
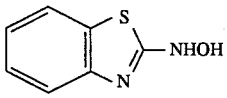
B-34
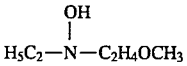
B-35
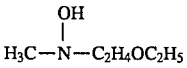
B-36
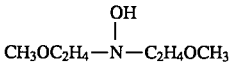
B-37
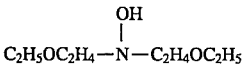
B-38
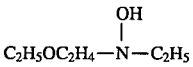
B-39
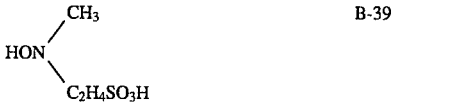
B-40
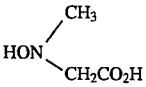
B-41
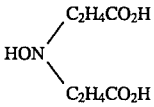
B-42
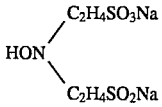

-continued

B-43

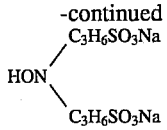

B-44

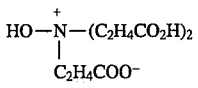

B-45

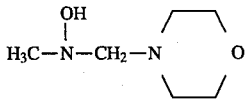

B-46

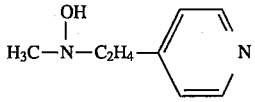

B-47

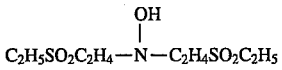

B-48

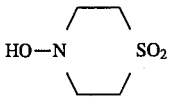

B-49

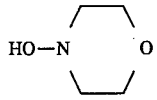

B-50

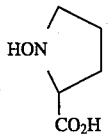

B-51

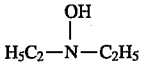

B-52

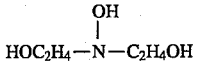

B-53

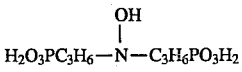

B-54

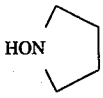

The compounds represented by formula (C) are described below in detail.

Examples of the alkyl group represented by A include straight-chain, branched and cyclic alkyl groups. Examples of the aryl group represented by A include a phenyl group, and a naphthyl group. Examples of the alkoxy group represented by A include straight-chain and branched alkyl groups. Examples of the aryloxy group represented by A include a phenoxy group and a naphthyloxy group. Examples of the alkylamino group represented by A include straight-chain and branched alkylamino groups. Examples of the acyl group represented by A includes straight-chain and branched acyl groups. Examples of the carbamoyl group represented by A includes straight-chain and branched carbamoyl groups. Examples of the sulfamoyl group represented by A include straight-chain and branched sulfamoyl groups. Examples of the heterocyclic group represented by A include a 5- or 6-membered heterocyclyl group which is constituted of carbon atom(s), nitrogen atom(s), oxygen atom(s) and/or sulfur atom(s), such as a furyl group, a pyrrolyl group, an imidazolyl group, a pyrazolyl group, a triazolyl group, a pyridyl group, a pyrimidinyl group, a triazinyl group, a thiazolyl group, a morpholino group or so on. Those groups may have substituent(s). Examples of such substituents include an alkyl group, an aryl group, a halogen atom, a nitro group, a hydroxy group, an alkoxy group, an aryloxy group, an alkylthio group, an arylthio group, an acyloxy group, an amino group, an alkylamino group, a carbonamido group, a sulfonamido group, an oxycarbonylamino group, an ureido group, an acyl group, an oxycarbonyl group, a carbamoyl group, a sulfonyl group, a sulfamoyl group, a carboxyl (including carboxylate) group, a sulfo (including sulfonate) group, a hydroxyaminocarbonyl group and a heterocyclic group. Details of these substituents are the same as those of the groups cited as the substituent(s) of $R_2$ and $R_3$ in formula (B).

Preferred examples of A in formula (C) include a substituted or unsubstituted alkyl group containing 1 to 5 carbon atoms (e.g., methyl, ethyl, hydroxyethyl, carboxyethyl, sulfopropyl), a substituted or unsubstituted aryl group (e.g., phenyl, p-methylphenyl, p-hydroxyphenyl, m-sulfophenyl), a substituted or unsubstituted alkoxy group containing 1 to 5 carbon atoms (e.g., methoxy, ethoxy, propoxy, butoxy, 2-methoxyethoxy), a substituted or unsubstituted aryloxy group (e.g., phenoxy) and a substituted or unsubstituted amino group (e.g., amino, methylamino, dimethylamino, diethylamino), and particularly preferably a substituted or unsubstituted alkoxy, aryloxy or amino group.

The group represented by X in formula (C) is —C(=O)—, —C(=S)—, —$SO_2$— or —SO—, preferably —C(=O)—.

The group represented by $R_4$ in formula (C) is a hydrogen atom; a straight-chain, branched or cyclic alkyl group; or an aryl group (e.g., a phenyl group, a naphthyl group). $R_4$ and A may be linked to each other to form a ring structure. These groups may have a substituent. As for the substituent, the groups instanced as the substituents of A can be applied thereto. $R_4$ is preferably a hydrogen atom or an alkyl group containing 1 to 5 carbon atoms (e.g., methyl, ethyl, propyl, butyl, carboxymethyl, carboxyethyl, sulfopropyl), particularly a hydrogen atom.

Y in formula (C) represents a hydrogen atom or a group capable of being converted into a hydrogen atom by hydrolysis reaction. Specific examples of a group capable of being converted into a hydrogen atom by hydrolysis include the following:

1) groups protected by an ester or urethane linkage, that is, groups represented by —C(=O)—$R_7$, wherein $R_7$ is an alkyl group, an aryl group, an amino group or so on.

2) groups protected by the imidomethyl blocking groups described in JP-A-57-158638, that is, groups represented by the following formula (G):

(G)

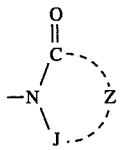

wherein J represents —C(=O)— or —$SO_2$—, and Z represents a plurality of atoms necessary to complete a hetero ring containing at least one 5- or 6-membered ring.

Specific examples of the compound represented by formula (C) are illustrated below. However, the invention should not be construed as being limited to these exemplified compounds.

C-1

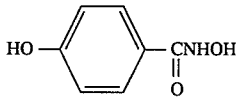

C-2

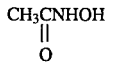

C-3

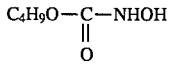

C-4

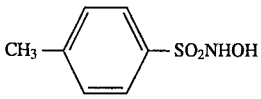

C-5

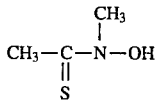

C-6

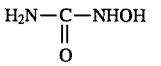

C-7

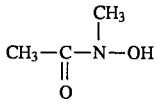

C-8

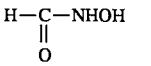

C-9

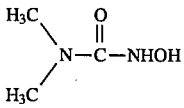

C-10

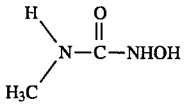

C-11

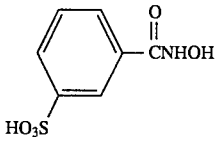

C-12

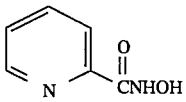

C-13

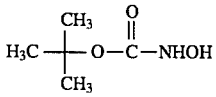

C-14

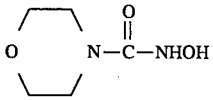

C-15

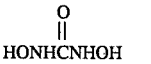

C-16

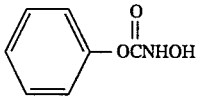

-continued

C-17

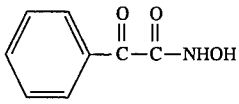

C-18

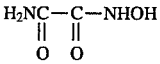

C-19

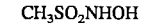

C-20

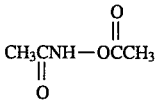

C-21

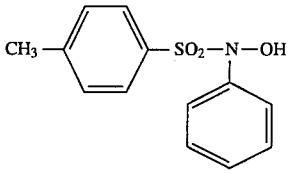

C-22

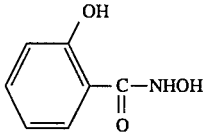

C-23

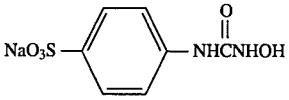

The compounds represented by formula (B) can be synthesized according to general methods as described, e.g., in *J. Am. Chem. Soc.*, 73, 2981; *J. Org. Chem.*, 33, 4271(1968); *J. Org. Chem.*, 27, 4504; *Tetrahedron Lett.*, 28, 2993(1987); *Synth. Commu.*, 9, 705(1979); U.S. Pat. Nos. 3,661,996, 3,362,961, 3,293,034, 3,491,151, 3,655,764, 3,467,711, 3,455,961, 3,287,125 and 3,287,124; JP-B-42-2794 (the term "JP-B" as used herein means an "examined Japanese patent publication), JP-B-49-10692; and so on.

The compounds represented by formula (C) can be synthesized according to general methods as described, e.g., in *Organic Functional Group Preparations III*, 406–432, Academic Press; *Synthetic Organic Chemistry*, pages 419, 565, 569, 576 and 577, John Wiley & Sons, Inc.; and so on.

These compounds may form salts by combining with various kinds of acids, such as hydrochloric acid, sulfuric acid, nitric acid, phosphoric acid, oxalic acid, acetic acid, etc.

The ascorbic acids or derivatives thereof represented by formula (A), which are used as developing agent in the present invention, may be free acids or may take the form of ammonium salt or alkali-metal salt. It is preferably that they be added to a developer in an amount of 0.005 to 1 mole/l, preferably 0.01 to 0.5 mole/l. To the developer, the compounds of formula (B) or (C) are further added in an amount of preferably from 0.005 to 2 moles/l, more preferably from 0.01 to 1 mole/l.

As for the p-aminophenol developing agent, N-methyl-p-aminophenol, p-aminophenol, N-(β-hydroxyethyl)-p-aminophenol, N-(4-hydroxyphenyl)glycine, 2-methyl-p-aminophenol and p-benzylaminophenol are examples thereof. In particular, N-methyl-p-aminophenol is preferred.

As for the 3-pyrazolidone developing agent, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone are examples thereof.

When the present developer contains the p-aminophenol developing agent or the 3-pyrazolidone developing agent, such an auxiliary developing agent is used in an amount of generally from 0.0005 to 0.2 mole/l, preferably from 0.001 to 0.1 mole/l.

The expression "not contain dihydroxybenzenes in a substantial sense" (or "do not substantially contain dihydroxybenzenes) as used in the present invention means that the concentration of dihydroxybenzenes in the developer is negligibly low (e.g., not higher than 0.0005 mole/l), compared with those of the compound of formula (A) and the above-cited auxiliary developing agents. For the present developer, however, it is preferable that dihydroxybenzenes be completely absent therein.

As for the sulfites used in the developer, sodium sulfite, potassium sulfite, lithium sulfite, ammonium sulfite, sodium bisulfite and potassium metabisulfite are examples thereof. Such sulfites are preferably used in an amount of at least 0.1 mole/l. The upper limit of the amount used is desirably 2 moles/l.

The pH of the developer used for development-processing is preferably in the range of 9 to 12, more preferably in the range of 9 to 11.

Examples of the alkali agent used for pH adjustment include pH modifiers such as sodium hydroxide, potassium hydroxide, sodium carbonate, potassium carbonate, sodium tertiary phosphate and potassium tertiary phosphate.

In the developer, dialdehyde series hardeners or bisulfite adducts thereof may be used. Specific examples of such hardeners include glutaraldehyde and the bisulfite adducts thereof.

In addition to the above-cited ingredients, the developer may contain as additives a development inhibitor such as sodium bromide, potassium bromide, etc.; an organic solvent such as ethylene glycol, diethylene glycol, triethylene glycol, dimethylformamide, etc.; a development accelerator such as alkanolamines (e.g., diethanolamine, triethanolamine), imidazole or a derivative thereof, etc.; and an antifoggant or a black pepper inhibitor such as a mercapto compound, an indazole compound, a benzotriazole compound, a benzimidazole compound, etc. Specific examples of an antifoggant or a black pepper inhibitor include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazole-2-yl)thio]butanesulfonate, 5-amino-1,3,4-thiadiazole-2-thiol, methylbenzotriazole, 4-methylbenzotriazole, 2-mercaptobenzotriazole and the like. These inhibitors are generally used in an amount of 0.01 to 10 mmol, preferably 0.1 to 2 mmol, per liter of the developer.

Further, various kinds of organic and inorganic chelating agents can be used simultaneously in the present developer. As for the inorganic chelating agents, sodium tetrapolyphosphate, sodium hexametaphosphate and so on can be used.

As for the organic chelating agents, organic carboxylic acids, aminopolycarboxylic acids, organic phosphonic acids, aminophosphonic acids and organic phosphonocarboxylic acids can be mainly employed.

Examples of organic carboxylic acids which can be used herein include acrylic acid, oxalic acid, malonic acid, succinic acid, glutaric acid, adipic acid, pimelic acid, azelaic acid, sebacic acid, nonanedicarboxylic acid, decanedicarboxylic acid, undecanedicarboxylic acid, maleic acid, itaconic acid, malic acid, Citric acid and tartaric acid. It is a matter of course that other organic carboxylic acids can also be used in the present developer.

Examples of aminopolycarboxylic acids which can be used herein include iminodiacetic acid, nitrilotriacetic acid, nitrilotripropionic acid, ethylenediaminemonohydroxyethyltriacetic acid, ethylenediaminetetraacetic acid, glycol-ether-tetraacetic acid, 1,2-diaminopropanetetraacetic acid, diethylenetriaminepentaacetic acid, triethylenetetramine-hexaacetic acid, 1,3-dimaino-2-propanoltetraacetic acid, glycol-ether-diaminetetraacetic acid, and the compounds described in JP-A-52-25632, JP-A-55-67747, JP-A-57-102624, JP-B-53-40900 and so on.

Examples of organic phosphonic acids which can be used herein include the hydroxyalkylidenediphosphonic acids as described, e.g., in U.S. Pat. Nos. 3,214,454 and 3,794,591, and West German Patent Application (OLS) No. 2,227,639, and the compounds described in *Research Disclosure*, volume 181, Item 18170 (May, 1979).

Examples of aminophosphonic acids which can be used herein include aminotris(methylenephosphonic acid), ethylenediaminetetramethylenephosphonic acid and aminotrimethylenephosphonic acid. In addition, there can be used the compounds described, e.g., in the foregoing *Research Disclosure* Item 18170, JP-A-57-208554, JP-A-54-61125, JP-A- 55-29883 and JP-A-56-97347.

Examples of organic phosphonocarboxylic acids which can be used herein include the compounds described, e.g., in JP-A-52-102726, JP-A-53-42730, JP-A-54-121127, JP-A-55-4024, JP-A-55-4025, JP-A-55-126241, JP-A-55-65955, JP-A-55-65956 and the foregoing *Research Disclosure* Item 18170.

The above-cited chelating agents may be used in the form of alkali-metal salt or ammonium salt. The amount of those chelating agents added to the developer ranges preferably from $1\times10^{-4}$ to $1\times10^{-1}$ mole/l, more preferably from 1×10–3 to $1\times10^{-2}$ mole/l.

In the developer, the compounds described in JP-A-56-24347, JP-B-56-46585, JP-B-62-2849 and JP-A-04-362942 can further be used as silver stain inhibitor.

In the developer, there can also be used the compounds described in JP-A-63-212651 as developer streaks inhibitor, and the compounds described in JP-A-61-267759 as dissolution aid.

Furthermore, the developer may contain a color toning agent, a surfactant, an antifoaming agent, a hardening agent and so on, if desired.

As for the buffers which can be used in the present developer, carbonates, the boric acid described in JP-A-62-186259 and the substances described in JP-A-60-93433, including the sugars (e.g., saccharose), the oximes (e.g., acetoxime), the phenols (e.g., 5-sulfosalicylic acid) and the tertiary phosphates, are examples thereof. In particular, carbonates are preferred over the others.

The development-processing temperature and time correlate with each other, and they are determined depending on the total processing time. In general, the development temperature is in the range of about 20° C. to about 50° C., preferably 25° C. to 45° C., and the development time is in the range of 5 seconds to 2 minutes, preferably 7 seconds to 1 minute and 30 seconds.

In processing 1 $m^2$ of the silver halide black-and-white photosensitive material, the amount of the developer to be replenished is at most 500 ml, preferably at most 400 ml.

For the purpose of reducing the transportation cost of processing solutions and the cost of wrapping materials, and saving the storage space, it is desirable that the processing solutions be stored in a concentrated condition and be diluted at the time of their use. For the concentration, it is effective to convert every salt-form ingredient in the developer into the potassium salt thereof.

In order to accelerate the development and increase the contrast, and for other purposes, the present developer can contain the amino compounds, including alkanolamines, as described in EP-A-0136582, British Patent 958,678, U.S. Pat. No. 3,232,761, JP-A-56-106244, JP-A-50-106244, JP-A-61-267759 and JP-A-02-208652.

In addition to the aforementioned ingredients, the present developer may contain the compounds described, e.g., in F. A. Mason, *Photographic Processing Chemistry*, pages 226–229, Focal Press (1966), U.S. Pat. Nos. 2,193,015 and 2,592,364, JP-A-48-64933.

The developer using the above-cited ingredients can be prepared using the methods described in JP-A-61-177132, JP-A-03-134666 and JP-A-03-67258. The replenishment of the developer can be carried out using the method described in JP-A-5-216180.

The fixer used in the fixation step is a water solution containing sodium thiosulfate or ammonium thiosulfate and, if desired, tartaric acid, citric acid, gluconic acid, boric acid, iminodiacetic acid, 5-sulfosalicylic acid, glucoheptanic acid, Tiron, ethylenediaminetetraacetic acid, diethylenetriaminepentaacetic acid, nitrilotriacetic acid or/and salts thereof. From the viewpoint of current environmental protection, the absence of boric acid is preferred.

Although sodium thiosulfate, ammonium thiosulfate or the like is used as a fixing agent for the fixer, ammonium thiosulfate is preferred with respect to fixation speed, but sodium thiosulfate is preferred from the viewpoint of current environmental protection. The amount of these known fixing agents to be used can be appropriately changed, but it ranges generally from about 0.1 to about 2 moles per l of fixer, particularly preferably from 0.2 to 1.5 moles per l of fixer.

The fixer can optionally contain hardeners (e.g., a water-soluble aluminum compound), preservatives (e.g., a sulfite, a bisulfite), pH buffers (e.g., acetic acid), pH modifiers (e.g., ammonia, sulfuric acid), chelating agents, surfactants, wetting agents, and fixation accelerators.

As examples of surfactants, mention may be made of anionic surfactants such as sulfates, sulfonate, etc., polyethylene surfactants, and the amphoteric surfactants described in JP-A-57-6740. Also, known antifoaming agents may be added. As for the wetting agents, alkanolamines and alkylene glycols are examples thereof. As for the fixation accelerators, there can be instanced the thiourea derivatives and the alcohols having a triple bond in a molecule as described, e.g., in JP-B-45-35754, JP-B-58-122535 and JP-B-58-122536, the thioether compounds described in U.S. Pat. No. 4,125,459, and the meso ion compounds described in JP-A-04-229860. In addition, the compounds described in JP-A-02-44355 may be used.

As for the pH buffers, there can be used organic acids, such as acetic acid, malic acid, succinic acid, tartaric acid, citric acid, oxalic acid, maleic acid, glycolic acid, adipic acid, etc., and inorganic acids such as boric acid, phosphates, sulfites, etc. Of these acids, acetic acid, tartaric acid and sulfites are preferred over the others.

The pH buffers are used for the purpose of prevention of a rise in pH of the fixer by the developer brought thereinto, and added to the extent of from 0.01 to 1.0 mole/l, preferably from 0.02 to 0.6 mole/l.

Also, the compounds described in JP-A-64-4739 can be used as dye-elution accelerator.

A hardener in the present fixer is a water-soluble aluminum or chromium salt. A water-soluble aluminum salt is preferred, and examples thereof are aluminum chloride, aluminum sulfate and potassium alum. The addition amount thereof is preferably from 0.01 to 0.2 mole/l, more preferably from 0.03 to 0.08 mole/l.

The fixation temperature ranges from about 20° C. to about 50° C., preferably from 25° C. to 45° C., and the fixation time ranges from 5 seconds to 1 minute, preferably from 7 seconds to 50 seconds.

The amount of the fixer replenished is preferably below 600 ml, particularly at most 500 ml, per $m^2$ of the photographic material processed.

The photographic material which have undergone development and subsequent fixation is subjected to washing or stabilization processing.

The washing or stabilization processing is generally carried out using washing water in an amount of at most 20 liter per $m^2$ of silver halide photographic material. However, such a processing can also be performed in a condition that the amount of water replenished is controlled to no more than 3 liter (including zero, that is, washing with standing water). In other words, not only water-saving processing is possible, but also the pipe arrangement upon installation of an automatic developing machine can be made unnecessary.

As for the method of reducing the amount of washing water to be replenished, a multistage counter current process (e.g., two- or three-stage) has been known for a long time. By application of this multistage counter current process to the present invention, more efficient washing becomes possible since the photographic material after fixation is processed with water which becomes cleaner and cleaner, that is, the processing proceeds as the material is brought into contact with successive, processing solutions which are less and less polluted with the fixer.

In carrying out a small-amount washing step, it is more desirable to install a washing tank equipped with the squeegee or crossover rollers as described, e.g., in JP-A-63-18350 and JP-A-62-287252. Further, the washing step may be performed in combination with the addition of various oxidizing agents and a filtering operation with the intention of reducing the pollution loading Which comes into question in the small-amount washing step.

Furthermore, as described in JP-A-60-235133, part or all of the solution overflowing a washing or stabilizing bath by replenishing the bath with the water which has received a moldproof treatment can be used in the prior step for a processing solution having a fixability.

In addition, a water-soluble surfactant and an antifoam agent may be added to the washing or stabilizing bath for the purpose of prevention of foam marks, which are apt to generate upon small-amount washing, and/or prevention of the transfer of processing chemicals adhering to squeegee rollers onto the films processed therein.

Also, the dye adsorbents described in JP-A-63-163456 may be placed in the washing tank in order to prevent the stains arising from dyes eluted from the photographic material.

In certain cases, the aforementioned washing step is followed by the stabilizing step. For instance, the baths containing the compounds described in JP-A-02-201357, JP-A-02-132435, JP-A-01-102553 and JP-A-46-44446 may be used as the final bath.

Into those stabilizing baths can be added ammonium compounds, compounds of Bi, Al or like metals, brightening agents, various chelating agents, film pH modifiers, hardeners, bactericides, antimolds, alkanolamines and surfactants.

As for the water used in the washing or stabilizing process, not only city water but also deionized water and the water sterilized by means of a halogen lamp, a ultraviolet sterilization lamp, various oxidants (e.g., ozone, hydrogen peroxide, chlorates) or so on are suitable examples thereof. In addition, washing water containing the compounds described in JP-A-04-39652 and JP-A-05-241309 may be employed.

As for the temperature of the washing or stabilizing bath and the processing time therein, it is preferable for them to be within the range of 5 seconds to 2 minutes under 0°–50° C.

The processing solutions used in the present invention are preferably preserved with the wrapping material having low oxygen-permeability described in JP-A-61-73147.

On the other hand, the processing solutions used in the present invention may be stored in the form of powder material or solid matter. Therein, although known methods can be adopted, it is preferable to employ the methods described in JP-A-61-259921, JP-A-04-85533 and JP-A-04-16841. In particular, the method described in JP-A-61-259921 is used to advantage.

When a replenisher is used in a reduced amount, it is desirable that the processing bath be prevented from evaporating and undergoing air oxidation by diminishing the contact area of the processing tank with air. A roller transport type automatic developing machine, which is simply referred to as a roller auto processor hereinafter, is described, e.g., in U.S. Pat. Nos. 3,025,779 and 3,545,971. The roller auto processor comprises four processes, namely developing, fixing, washing and drying processes. Although other processes (e.g., a stop process) are not excluded in the present invention also, it is most desirable to follow those four processes. The washing process may be replaced by the stabilizing process.

In the water-saving processing or pipingless processing, it is desirable that a moldproof means be applied to the washing water or stabilizing bath. As for the washing water, it is preferable in many cases to carry out such a pretreatment as to remove dust and organic substances from water by passing the water through a filter or an active carbon layer before supplying the water to a washing tank.

As treatments for the washing water, the UV irradiation method (which is known as moldproof means) described in JP-A-60-263939, the magnetic field application method described in JP-A-60-263940, the method of purifying water with ion exchange resins as described in JP-A-61-131632, the method of circulating water through a filter and an adsorbent column while ozone is blown thereinto as described in Japanese Patent Application No. 2-208638 and JP-A-4-151143, the method of using bacterial degradation as described in Japanese Patent Application No. 3-24138, and the methods of using germicides as described in JP-A-62-115154, JP-A-62-153952, JP-A-62-220951 and JP-A-62-209532 can be adopted in combination of two or more thereof.

Further, there can be optionally used the germicides, the antimolds and the surfactants as described in M. W. Reach, *SMPTE Journal*, vol. 85 (1976), entitles "Microbiological Growths in Motion-Picture Processing"; R. O. Deegan, *J. Imaging Tech*, vol. 10, No. 6 (1984), entitled "Photo Processing Wash Water Biocides"; and JP-A-57-8542, JP-A-57-58143, JP-A-58-105145, JP-A-57-132146, JP-A-58-18631, JP-A-57-97530, and JP-A-57-257244.

Furthermore, the isothiazoline compounds and bromochloromethylhydantoin described in R. T. Kreiman, *J. Imaging Tech.*, vol. 10, No. 6, p. 242 (1984); the isothiazoline compounds described in *Research Disclosure*, vol. 205, No. 20526 (May, 1981), and ibid., vol. 228, No. 22845 (April, 1983); and the compounds described in JP-A-62-209532 can be used as bactericides in the washing bath (or the stabilizing bath), if needed.

In addition, such a bath may contain the compounds as described in Hiroshi Horiguchi, *Bohkin Bohbai no Kagaku* (which means "Antibacterial and Moldproof Chemistry"), Sankyo Shuppan (1982); and *Bohkin Bohbai Gijutsu Handbook* (which means "Handbook of Antibacterial and Moldproof Arts"), compiled by Nippon Bohkin Bohbai Gakkai, published by Hakuhodo (1986).

After successively developing, fixing and washing (or stabilizing) the photographic material, the washing water is drained out of the photographic material. More specifically, the washing water is removed from the photographic material by means of a squeegee roller, followed by a drying operation. The drying operation is effected at 40°–100° C., and the drying time, though can be appropriately chosen, ranges generally from about 5 seconds to 3 minutes. Preferably, the drying operation is carried out at 40°–80° C. for 5 seconds to 2 minutes.

When the photographic processing is carried out under a dry-to-dry processing time of below 100 seconds, it is desirable to take a measure to prevent the generation of developer streaks characteristic of rapid processing. For instance, the rubber-made roller described in JP-A-63-151944 is applied to the roller of a developing tank exit, the rate of a jet flow for agitating the developer in a developing tank is adjusted to at least 10 m/minute as described in JP-A-63-151944, and the developer is agitated more vigorously during development than upon standing ready for development. In order to effect the rapid processing, it is more desirable that rollers installed in a fixing tank be constructed by counter rollers, thereby increasing the fixation speed. In addition, the counter-roller construction can lessen the number of rollers, thereby reducing the volume of a processing tank. That is, the auto processor can be rendered more compact.

The present processing method does not have any particular restriction as to the photographic materials to which it is applied. It can be applied to not only general black-and-white photographic materials but also color photographic materials to undergo reversal processing (e.g., color reversal film and paper). In particular, it is preferable for the present processing method to be applied to the photographic materials used in a laser printer for recording clinical images, graphic arts films, medical X-ray sensitive materials for direct taking, medical films for fluorography, hard films of hydrazine nucleation type, photographic materials for CRT image recording, microfilms, black-and-white negative films for amateur use, black-and-white photographic papers and so on.

A silver halide emulsion which can be used in the present invention has no particular restriction as to halide composition, and it may be a dispersion of any silver halide, e.g., silver chloride, silver iodide, silver bromide, silver chlorobromide, silver iodobromide, silver chloroiodobromide, etc., in a hydrophilic colloid.

In general, the silver halide emulsion is prepared by mixing a water-soluble silver salt (e.g., silver nitrate) with water-soluble halide(s) in the presence of water and a hydrophilic colloid in accordance with a method well-known to one skill in the art (e.g.,.a single jet method, a double jet method or a controlled double jet method), and subjecting the resulting mixture to successive physical ripening and chemical ripening, including gold sensitization, sulfur sensitization, combination thereof and so on. The silver halide used in the present invention have no particular limitation on its grain form, but it has any of grain forms, including a cubic crystal form, an octahedral crystal form, a spherical grain form and a tabular grain form having a high aspect ratio as described in *Research Disclosure*, Item 22534 (January, 1983).

When a photographic material contains a hydrazine compound, though there is no particular restriction on silver halide as a constituent thereof, it is preferable for the silver halide to be a silver chlorobromide or iodochlorobromide having a chloride content of at least 50 mole %. The iodide content therein is preferably at most 3 mole %, and more preferably at most 0.5 mole %. The grain form of the silver halide is preferably a cubic crystal form, although it may be any of a cubic crystal form, a tetradecahedral crystal form, an octahedral crystal form, an indefinite form and a plate form. The average grain size of silver halide ranges preferably from 0.1 to 0.7 μm, and more preferably from 0.2 to 0.5 μm. The variation coefficient defined by {(standard deviation of grain size distribution)/(average grain size)}×100 is preferably 15% or below, more preferably 10% or below. That is, it is preferable for the silver halide to have a narrow grain size distribution.

The silver halide grains may be uniform throughout, or the surface and the core thereof may be different to form a layer structure.

Photographic emulsions can be made using the methods described, e.g., in P. Glafkides, *Chimie et Physique Photographique* (published by Paul Montel in 1967); G. F. Duffin, *Photographic Emulsion Chemistry* (published by The Focal Press in 1966); V. L. Zelikman et al., *Making and Coating Photographic Emulsion* (published by The Focal Press in 1964); and so on.

Suitable methods for reacting a water-soluble silver salt with a water-soluble halide include, e.g., a single jet method, a double jet method, or a combination thereof.

Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may also be employed. Further, it is desirable that the grains be formed in the presence of the so-called silver halide solvent, such as ammonia, a thioether, a tetrasubstituted thiourea compound or the like. Preferable silver halide solvents are the tetrasubstituted thiourea compounds described in JP-A-53-82408 and JP-A-55-77737. Suitable thiourea compounds are tetramethylthiourea and 1,3-dimethyl-2-imidazolidinedione.

According to the controlled double jet method and the grain formation method using a silver halide solvent, a silver halide emulsion having a regular crystal form and a narrow grain size distribution can be prepared with ease. Therefore, those methods are used to advantage in making silver halide emulsions used in the present invention.

In order to obtain an almost uniform distribution of grain sizes, it is further desired that the grain growth be speeded up within the critical saturation limit using the method as described in British Patent 1,535,061, JP-B-48-26890 and JP-B-52-16364, wherein the addition speeds of silver nitrate and an alkali halide are changed depending on the grain growth speed, or the method as described in British Patent 4,242,445 and JP-A-55-158124, wherein the concentration of a water solution is changed.

In the case of a X-ray sensitive material, it is desirable that the total coverage rate of silver on both sides of the support be not at most 8.0 g/m$^2$, preferably not more than 4.0 g/m$^2$. The sensitive material can have a hydrophilic colloid layer in addition to silver halide emulsion layers, if desired. Preferably, the material is provided with a surface protecting layer according to a known method. Further, it is desirable that the total coverage rate of gelatin on the side where the sensitive material has hydrophilic colloid layers, including an emulsion layer, be adjusted to at least 2.0 g/m$^2$ and less than 5.0 g/m$^2$, especially not less than 2.5 g/m$^2$ and less than 4.0 g/m$^2$. Furthermore, it is desirable that the sensitive material be designed so as to have a melting time of from 20 to 100 minutes. The melting time can be determined in accordance with the measurement method described in JP-A-63-221341.

A halogen surfactant photographic material has on a support at least one halogen surfactant emulsion layer. In the case of a medical X-ray sensitive material for direct taking, as described, e.g., in JP-A-58-127921, JP-A-59-90841, JP-A-58-111934 and JP-A-61-211235, it is preferable for the material to have at least one silver halide emulsion layer on each side of the support.

The photographic material can have other layers, such as an interlayer, a filter layer, an antihalation layer, etc., if needed.

The silver coverage rate of the sensitive material is preferably in the range 0.5–5 g/m$^2$ (on one side), and more preferably in the range 1–3 g/m$^2$ (on one side).

In view of rapid processing suitability, it is desirable that the silver coverage rate do not exceed 5 g/m$^2$. In order to obtain consistent image density and contrast, on the other hand, the silver coverage rate of not less than 0.5 g/m$^2$ is favorable.

Emulsion grains, or silver halide grains in an emulsion, used in an X-ray sensitive material may have a regular crystal form, such as that of a cube or an octahedron, or an irregular crystal form such as a sphere, a plate, or a potato-like shape. Further, the emulsion grains may be a mixture of grains of various crystal forms.

The composition of silver halide grains may be any of silver iodobromide, silver bromide, silver iodochlorobromide, silver chlorobromide, silver iodochloride and silver chloride. From the standpoint of high sensitivity and excellent rapid processability, however, it is preferable for the composition to be silver iodobromide having an iodide content of at most 0.6 mole % or silver iodochlorobromide or chlorobromide having a chloride content ranging from 20 mole to less than 100 mole %, particularly from 50 mole % to less than 99 mole %.

Monodisperse emulsions are used to advantage. Preparation methods thereof are known, and thereto can be properly applied the arts described, e.g., in *J. Photo. Sci.*, 12, 242–251 (1963), JP-B-48-36890, JP-B-52-16364, JP-A-55-142329 and JP-A-57-179835. In addition, the emulsions may be those having a core/shell structure, which are known in JP-A-54-48521 and so on.

Tabular-grain emulsions are also used to advantage. For details thereof, *Research Disclosure*, Volume 225, Item 22534, pages 20–58 (January 1983), JP-A-58-127921, JP-A-58-113926, JP-A-58-113927, JP-A-58-113928 and U.S. Pat. No. 4,439,520 can be referred to.

For the tabular-grain emulsions, it is preferable to have a projection area diameter ranging from 0.3 to 2.0 μm, particularly from 0.5 to 1.2 μm, a thickness ranging from 0.05 to 0.3 μm, particularly from 0.1 to 0.2 μm, and an aspect ratio ranging from 3 to less than 20, particularly from 5 to less than 12.

As for the tabular grains, monodisperse tabular grains are especially useful in the present invention. The term "monodisperse tabular grains" as used herein is intended to include the emulsion grains defined in JP-A-63-151618 and JP-A-01-158426 wherein the structure and the preparation methods thereof are described in detail.

In view of the prevention of environmental pollution, it is desirable to apply tabular-grain silver chlorobromide and/or chloride emulsions to X-ray sensitive materials. With respect to crystal habits of the silver chlorobromide and/or chloride tabular-grain emulsions, there are known the emulsion grains having the (111) surfaces predominantly and the emulsion having the (100) surfaces predominantly. The (111) silver chlorobromide tabular-grain emulsions are known in JP-B-64-8325, JP-B-64-8326, JP-A-62-111936, JP-A-62-163046 and so on.

On the other hand, the (100) silver chlorobromide tabular-grain emulsions are described, e.g., in JP-A-51-88017, JP-B-64-8323 and EP-A1-0534395. In particular, the arts described in JP-A-7-120857 and JP-A-7-128767 are desirable because they can ensure narrow distribution of grain sizes and high sensitivity. Also, the combination of the (100) silver chloride tabular-grain emulsion as described in JP-A-7-168323 with the development-processing with an ascorbic acid is favorable.

The use of tabular-grain silver halide emulsions can further heighten the consistency in photographic properties obtained during the running operation according to the present processing method. In addition, a reduction in silver coverage becomes possible by the use of such emulsions, and thereby can be lightened processing loads, particularly the loads of fixation and drying. In this respect also, such emulsions enable rapid processing.

Tabular-grain silver halide emulsions are described, e.g., by Cugnac and Chateau, entitled "Evolution of the Morphology of Silver Bromide Crystals during Physical Ripening" in *Science et Industrie Photographigue*, Vol. 33, No. 2 (1962), pages 121–125; by Duffin in *Photographic Emulsion Chemistry*, The Focal Press, New York (1966), pages 66–72; and by A. P. H. Trivelli and W. F. Smith in *Photographic Journal*, volume. 80, page 285 (1940). Such emulsions can be prepared with ease by referring to the methods as described, e.g., in JP-A-58-127921, JP-A-58-113927 and JP-A-58-113928.

Also, tabular-grain emulsions can be obtained by forming seed crystals, in which tabular grains are present in a proportion of at least 40% by weight, in an atmosphere of pBr 1.3 or less, or a relatively high bromide ion activity concentration, and then by growing the seed crystals while silver and halogen solutions are added simultaneously under the pBr value maintained at the same level as the above.

In the grain growth process, it is desirable that the silver and halogen solutions be added so as not to cause new nucleation.

The size of tabular silver halide grains can be adjusted to an intended one by properly choosing the temperature and the kind and amount of a solvent used, and further by controlling the addition speeds of silver salt and halide solutions used in the grain growth process.

In order to achieve high contrast and low fog, it is desirable that at least one metal chosen from among rhodium, rhenium, ruthenium, osmium and iridium be present inside the silver halide grains used in a silver halide photographic material. The content of such a metal is preferably in the range of $1\times10^{-9}$ to $1\times10^{-5}$ mole, more preferably in the range of $1\times10^{-8}$ to $5\times10^{-6}$ mole, per mole of silver. The above-cited metals may be used as a mixture of two or more thereof. These metals can be distributed evenly throughout the silver halide grains, or may have an uneven distribution inside the grains as described in JP-A-63-29603, JP-A-02-306236, JP-A-03-167545, JP-A-04-76534, JP-A-6-110146, and so on.

As for the rhodium compounds, water-soluble rhodium compounds can be used. Examples thereof include halogenated rhodium (III) compounds and rhodium complex salts having halogen ligands, amine ligands, oxalato ligands or so on, such as hexachlororhodium(III) complex salts, hexabromorhodium(III) complex salts, hexaamminerhodium(III) complex salts, trioxalatorhodium(III) complex salts and so on. These rhodium compounds are used as a solution in water or an appropriate solvent. Therein can be adopted a general method for stabilizing the solution of a rhodium compound, that is, a method of adding a water solution of hydrogen halide (e.g., hydrochloric acid, hydrobromic acid, hydrofluoric acid) or an alkali halide (e.g., KCl, NaCl, KBr, NaBr). Instead of using a water-soluble rhodium compound, rhodium-doped silver halide grains may be added during the preparation of the intended silver halide grains. By doing so, rhodium can be present inside the intended grains through the dissolution of the added grains.

Those compounds can be added either during the preparation of silver halide emulsion grains or at any stage before the coating of the emulsion, but it is preferable to add them during the formation of the emulsion, thereby incorporating them inside the silver halide emulsion grains.

Rhenium, ruthenium and osmium are added in the form of water-soluble complex salt as described, e.g., in JP-A-63-285941, JP-A-02-20852 and JP-A-02-20855. In particular, the complexes represented by the following formula which are characterized by the coordination number of 6 are preferred over others:

$$[ML_6]^{-n}$$

wherein M represents Ru, Re or Os, L is a ligand, and n is 0, 1, 2, 3 or 4.

The counter ions in such complexes are of no consequence, and they may be ammonium or alkali metal ions.

As examples of ligands suitable for the foregoing complexes, mention may be made of halide, cyanide, cyanate, nitrosyl and thionitrosyl ligands. Specific examples of complexes which can be used are illustrated below, but the invention should not be construed as being limited to these examples.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)(CN)_5]^{-2}$ | $[ReO_2(CN)_4]^{-3}$ |
| $[RuCl_6]^{-3}$ | $[RuCl_4(H_2O)_2]^{-2}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_6]^{-3}$ | $[OsCl_5(NO)]^{-2}$ | $[Os(NO)(CN)_5]^{-2}$ |
| $[Os(NS)Br_5]^{-2}$ | $[Os(CN)_6]^{-4}$ | $[OsO_2(CN)_4]^{-4}$ |

These compounds can be added either during the preparation of silver halide emulsion grains or at any stage before the coating of the emulsion, but it is preferable to add them during the formation of the emulsion, thereby incorporating them inside the silver halide emulsion grains.

In order to incorporate such metals into silver halide grains by the addition of the foregoing compounds during the formation of silver halide grains, there can be adopted a method of adding in advance such metal complexes as powders or solutions prepared by dissolving them in water together with NaCl or KCl, to the solution of a water-soluble silver salt or a water-soluble halide for grain formation; a method of preparing silver halide grains by simultaneously adding and mixing the three solutions, namely a silver salt solution, a halide solution and a water solution of metal complex as the third solution; or a method of pouring into a reaction vessel during the grain formation a required amount of solution prepared by dissolving a metal complex in water together with NaCl or KCl. In particular, the method of adding to a water-soluble halide solution the metal complex powder or the solution prepared by dissolving a metal complex in water together with NaCl or KCl is preferred over the others.

In order to add the foregoing metals to the grain surfaces, it is also possible to pouring a water solution of metal complex in a required amount into the reaction vessel just after the grain formation, during or after the physical ripening, or at the time of chemical ripening.

Iridium compounds of various species can be used. Examples thereof include hexachloroiridium, hexaammineiridum, trioxalatoiridium, hexacyanoiridium and so on. These iridium compounds are used as a solution in water or an appropriate solvent. Therein can be adopted a prevailing method for stabilizing the solution of an iridium compound, that is, a method of adding a water solution of hydrogen halide (e.g., hydrochloric acid, hydrobromic acid, hydrofluoric acid) or an alkali halide (e.g., KCl, NaCl, KBr, NaBr). Instead of using a water-soluble iridium compound, iridium-doped silver halide grains may be added during the preparation of the intended silver halide grains. By doing so, iridium can be present inside the intended grains through the dissolution of the added grains.

Silver halide grains may undergo doping of other heavy metal salts. In particular, the doping of an iron salt such as $K_4[Fe(CN)_6]$ is favored.

Into the silver halide grains may be introduced various metals such as cobalt, nickel, palladium, platinum, gold thallium, copper, lead and so on. The content of these metals are preferably in the range of $1\times10^{-9}$ to $1\times10^{-4}$ mole per mole of silver halide. These metals can be introduced in the grains by adding them in the form of single salt, double salt or complex salt during the preparation of the grains.

It is preferable for the silver halide emulsions to be chemically sensitized. The chemical sensitization can be effected using known processes, such as a sulfur sensitization process, a selenium sensitization process, a tellurium sensitization process, a reduction sensitization process, a sensitization process utilizing a precious metal, etc., and these processes may be used individually or in combination of two or more thereof. Preferred combinations are the combination of a sulfur sensitization process and a gold sensitization process, that of a sulfur sensitization process, a selenium sensitization process and a gold sensitization process, and that of a sulfur sensitization process, a tellurium sensitization process and a gold sensitization process.

The sulfur sensitization is, in general, carried out by adding a sulfur sensitizer to an emulsion and agitating the emulsion for a prescribed time at a high temperature of at least 40° C. As for the sulfur sensitizer, various known sulfur compounds can be used, with examples including the sulfur compounds contained in gelatin, thiosulfates, thioureas, thiazoles, rhodanines and so on. Of these compounds, thiosulfates and thiourea compounds are preferred over the others. The amount of a sulfur sensitizer to be added varies depending upon the pH and temperature upon chemical ripening, the size of silver halide grains and other various conditions. However, it is generally in the range of $10^{-7}$ to $10^{-2}$ mole, preferably $10^{-5}$ to $10^{-3}$ mole, per mole of silver halide.

As for the selenium sensitizer, known selenium compounds can be used. More specifically, the selenium sensitization is, in general, carried out by adding an unstable and/or non-unstable selenium compound(s) to an emulsion and agitating the emulsion for a prescribed time at a high temperature of at least 40° C. Specific examples of an unstable selenium compound which can be used include the compounds described, e.g., in JP-B-44-15748, JP-B-43-13489, JP-A-4-25832, JP-A-4-109240 and JP-A-4-324855. In particular, the compounds represented by formulae (VIII) and (IX) are used to advantage.

A tellurium sensitizer is a compound capable of producing silver telluride, which is assumed to form the sensitization speck, at the surface or inside the silver halide grains. The producing speed of silver telluride can be examined using the method described in JP-A-5-313284.

Specific examples of a compound which can be used as tellurium sensitizer include the compounds described in U.S. Patents 1,623,499, 3,320,069 and 3,772,031; British Patents 235,211, 1,121,496, 1,295,462 and 1,396,696; Canadian Patent 800,958; JP-A-4-204640, JP-A-4-271341, JP-A-4-333043, JP-A-5-303157; *J. Chem. Soc. Chem. Commun.*, 635(1980); ibid., 1102(1979); ibid., 645(1979); *J. Chem. Soc. Perkin. Trans.*, 1, 2191(1980); *The Chemistry of Organic Selenium and Tellurium Compounds*, compiled by S. Patai, vol. 1 (1986); and ibid., vol. 2 (1987). In particular, the compounds represented by formulae (II), (III) and (IV) in JP-A-5-313284 are favored.

The amounts of selenium and tellurium sensitizers used are changed depending on the silver halide grains used, the chemical ripening condition adopted, and so on. These sensitizers are generally used in an amount of about $10^{-8}$ to about $10^{-2}$ mole, preferably about $10^{-7}$ to $10^{-3}$ mole, per mole of silver halide. The present invention does not have any particular restriction as to the conditions of chemical sensitization, but it is desirable that the chemical sensitization be carried out under the pH 5–8, pAg 6–11 (preferably 7–10), and the temperature of 40°–95° C. (preferably 45°–85° C.).

As for the precious metal sensitizers, gold, platinum and palladium compounds are examples thereof. In particular, gold sensitizers are preferred over the others. Specific examples of gold sensitizers which can be used include chloroauric acid, potassium chloroaurate, potassium auritincyanate and gold sulfide. These compounds can be used on the order of $10^{-7}$–$10^{-2}$ mole per mole of silver halide.

In a process of producing silver halide grains or allowing the produced silver halide grains to ripen physically, there may be present various salts such as cadmium salts, zinc salts, lead salts, thallium salts and so The reduction sensitization can also be used in the present invention. As reduction sensitizers, stannous salts, amines, formamidinesulfinic acid, silane compounds and so on can be employed.

To the silver halide emulsions may be added a thiosulfonic acid compound in accordance with the method described in European Patent 0,293,917.

In the photographic material, only one kind of silver halide emulsion may be used or two or more kinds of silver halide emulsions (differing, e.g., in average grain size, halide composition, crystal habit, or condition of chemical sensitization) may be used in combination.

Although the silver halide emulsions may be multidisperse ones, monodisperse emulsions are preferred thereto. In particular, emulsions having a variation coefficient of not more than 20% with respect to the distribution of sizes among the grains are used to advantage for graphic arts sensitive materials. The term "monodisperse emulsion" as used herein signifies the silver halide emulsion having a variation coefficient of at most 20%, preferably not more than 15% with respect to the grain size distribution.

The variation coefficient (%) therein is defined as the value obtained by dividing the standard deviation of grain size distribution by the average grain size and then multiplying the quotient by 100.

The interior and the surface of the silver halide grains may differ, or the silver halide grains may be uniform throughout. Two or more kinds of separately made silver halide emulsions may be used as a mixture.

Further, the silver halide grains used in the present invention may be either grains of the kind which form latent image predominantly at the surface of the grains, or grains of the kinds which form latent image mainly inside the grains. Also, surface-prefogged grains may be used herein.

The term "swelling percentage" as used herein refers to the swelling value expressed in percentage which is determined by (a) subjecting the aforementioned photographic material to the incubation treatment for 3 days under the condition of 38° C.–50% RH, (b) measuring the thickness of a hydrophilic colloid layer, (c) soaking the photographic material in 21° C. distilled water for 3 minutes, and then (d) comparing the thickness of the soaked layer with the thickness of the hydrophilic colloid layer measured in the step (b) to calculate a change in thickness.

As for the swelling percentage of a hydrophilic colloid layer comprising at least one silver halide emulsion layer, it is preferably not more than 300%, and more preferably ranges from 150% to 250% in the case of an X-ray sensitive material, while in the case of a graphic arts film it is preferably not more than 250%, and more preferably in the range of 100% to 200%.

More satisfactory increase in processing speed and simplification of photographic processing can be achieved by further reduction in the swelling percentage.

The reduction in the swelling percentage, on the other hand, lowers the rates of development, fixation and washing, and so it is undesirable to increase the swelling percentage beyond necessity.

As hardeners which can be used for controlling the swelling percentage, there are known organic compounds such as aldehyde compounds, the active halogen-containing compounds described in U.S. Pat. No. 3,288,775, the compounds containing ethylenic, reactive unsaturated group(s) as described in U.S. Pat. No. 3,635,718, the epoxy compounds described in U.S. Pat. No. 3,091,537, halogenocarboxyaldehydes (e.g., mucochloric acid), and so on. In particular, the hardeners of vinylsulfone type are preferred over the others. Also, polymeric hardeners can be used to advantage in the present invention.

As polymeric hardeners, polymers having active vinyl groups or precursors of such groups are favored. In particular, the polymers as described in JP-A-56-142524, which contain active vinyl groups or precursors thereof attached to their main chains via long spacers, are preferred over the others. The amount of a hardener added in order to achieve the swelling percentage required in the present invention depends on the type of the hardener used and the species of gelatin used.

It is desirable that silver halide grains be spectrally sensitized with sensitizing dyes. Suitable examples of dyes used for spectral sensitization include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-cited nuclei and an alicyclic hydrocarbon ring; and nuclei formed by fusing together one of the above-cited nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. These nuclei each may be present as a substituent on a carbon atom, also.

The merocyanine and complex merocyanine dyes can contain 5- or 6-membered heterocyclic nuclei, e.g., pyrazoline-5-one, thiohydantoin, 2-thioxazolidine-2,4-dione, thiazolidine-2,4-dione, rhodanine, thiobarbituric and like nuclei, as ketomethylene structure-containing nuclei.

Useful sensitizing dyes are those described, e.g., in *Research Disclosure*, volume 176, RD-17643, page 23 (Dec., 1978), and U.S. Pat. Nos. 4,425,425 and 4,425,426. Specifically, the following compounds can be used to advantage:

5,5'-Dichloro-3,3'-diethylthiacyanine bromide,

Sodium salt of 5,5'-dichloro-3,3'-di(4-sulfobutyl)thiacyanine,

Sodium salt of 5-methoxy-4,5-benzo-3,3'-di(3-sulfopropyl)thiacyanine, 5,5'-Dichloro-3,3'-diethylselenacyanine iodide, 5,5'-Dichloro-9-ethyl-3,3'-di(3-sulfopropyl)thiacarbocyanine pyridinium salt, Anhydro-5,5'-dichloro-9-ethyl-3-(4-sulfobutyl)-3'-ethyl hydroxide, 1,1-Diethyl-2,2'-cyanine bromide, 1,1'-Dipentyl-2,2'-cyanine perchlorate, 9-Methyl-3,3'-di(4-sulfobutyl)-thiacarbocyanine pyridinium salt, Sodium salt of 5,5'-diphenyl-9-ethyl-3,3'-di(2-sulfoethyl)-oxacarbocyanine, Sodium salt of 5-chloro-5'-phenyl-9-ethyl-3-(3-sulfopropyl)-3'-(2-sulfoethyl)oxacarbocyanine, Sodium salt of 5,5'-dichloro-9-ethyl-3,3'-di(3-sulfopropyl)oxacarbocyanine, Sodium salt of 5,5'-dichloro-6,6'-dichloro-1,1'-diethyl-3,3'-di(3-sulfopropyl)imidacarbocyanine, and Sodium salt of 5,5'-diphenyl-9-ethyl-3,3'-di(3-sulfopropyl)thiacarbocyanine.

As for the addition time of sensitizing dyes, the dyes are generally added to an emulsion before the emulsion is applied to an appropriate support, but they may be added during the chemical ripening or the formation of silver halide grains.

Examples of useful sensitizing dyes, supersensitizing combinations of dyes and materials which can exhibit supersensitizing effect are described, e.g., in the above-cited *Research Disclosure*, Volume 176, RD-17643 (December 1978), page 23, Item IV-J, and JP-B-49-25500, JP-B-43-4933, JP-A-59-19032 and JP-A-59-192242.

In order to incorporate sensitizing dyes in a silver halide emulsion, the dyes may be dispersed directly to the emulsion, or may be added to the emulsion in the form of solution in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide or a mixture of two or more thereof.

Also, the incorporation of sensitizing dyes can be effected using various other methods, such as the method as described in U.S. Pat. No. 4,469,987, wherein the dyes are dissolved in a volatile organic solvent, the resulting solution is dispersed into water or a hydrophilic colloid, and the dispersion obtained is added to an emulsion; the method as described in JP-B-46-24185, wherein water-insoluble dyes are dispersed into a water-soluble solvent without dissolving them in any solvent, and the dispersion obtained is added to an emulsion; the method as described in JP-B-44-23389, JP-B-44-27555, JP-B-57-22091 and so on, wherein dyes are dissolved in an acid and then added to an emulsion, or dyes are dissolved in water in the presence of an acid or a base and then added to an emulsion; the method as described in U.S. Pat. Nos. 3,822,135 and 4,006,026, wherein dyes are dissolved into water or dispersed into a colloid in the presence of a surfactant and the resulting water solution or colloidal dispersion is added to an emulsion; the method as described in JP-A-53-102733 and JP-A-58-105141, wherein dyes are dispersed directly to a hydrophilic colloid and the resulting dispersion is added to an emulsion; the method as described in JP-A-51-74624, wherein dyes are dissolved by the use of red shift compounds and the solution obtained is added to an emulsion; and so on.

In the dissolution of sensitizing dyes, ultrasonic waves can be utilized, too.

The sensitizing dyes may be added to a silver halide emulsion in any stage of emulsion-making, so far as the stage is known to be useful for the addition. For instance, the addition may be carried out during the formation of silver halide grains and/or in the period prior to desalting, or during the desalting and/or in a period from the end of desalting till the beginning of chemical ripening, as described, e.g., in U.S. Pat. Nos. 2,735,766, 3,628,960, 4,183,756 and 4,225,666, JP-A-58-184142 and JP-A-60-196749; and, as described, e.g., in JP-A-58-113920, the addition may be carried out at any time or in any process so far as it precedes the emulsion-coating, such as just before the chemical ripening, during the chemical ripening, or during the period from the chemical ripening till the emulsion-coating. Also, as disclosed in U.S. Pat. 4,225,666 and JP-A-58-7629, there may be adopted another addition manner such that one sensitizing dye or one combination of sensitizing dyes different in structure is divided into some portions, and the divided portions are added in separate processes. For instance, they are added in the grain-formation process and the chemical ripening process or a process after the chemical ripening, separately, or in a process before the chemical ripening or the chemical ripening process and a process after the chemical ripening, separately. In such a divisional addition, on the other hand, different dyes or combinations may be used in different processes.

The amount of sensitizing dyes added depends on the shape and size of silver halide grains to be sensitized, but it is preferably in the range of $4\times10^{-8}$ to $8\times10^{-2}$ mole per mole of silver halide.

For the purpose of improvement in pressure characteristics, the emulsion layers of photographic materials can contain polymer emulsions such as an alkylacrylate latex and plasticizers such as polyols (e.g., trimethylol propane).

The photographic materials may be designed so as to acquire ultra-hard photographic properties by the use of a hydrazine nucleation agent. The system designed with the aforementioned intention and hydrazine nucleation agents used therein are described in references cited below. This system is particularly suitable for graphic arts. The references include *Research Disclosure*, Item 23516 (November 1983) and the references cited therein, U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,760, British Patent 2,011,391 B, European Patents 217,310, 301,799 and 356,898, JP-A-60-179734, JP-A- 61-170733, JP-A-61-270744, JP-A-62-178246, JP-A-62-270948, JP-A-63-29751, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-64-90439, JP-A-01-100530, JP-A-01-105941, JP-A-01-105943, JP-A-01-276128, JP-A-01-280747, JP-A-01-283548, JP-A-01-283549, JP-A-01-285940, JP-A-02-2541, JP-A-02-139538, JP-A-02-177057, JP-A-02-196234, JP-A-02-196235, JP-A-02-198440, JP-A-02-198441, JP-A-02-198442, JP-A-02-220042, JP-A-02-221953, JP-A-02-221954, JP-A-02-230233, JP-A-02-285243, JP-A-02-285343, JP-A-02-289843, JP-A-02-302750, JP-A-02-304550, JP-A-03-37642, JP-A-03-54549, JP-A-03-125134, JP-A-03-184039, JP-A-03-240036, JP-A-03-240037, JP-A-03-259240, JP-A-03-280038, JP-A-03-282536, JP-A-04-51143, JP-A-04-56842, JP-A-04-84134, JP-A-04-96053, JP-A-04-216544, JP-A-05-45761, JP-A-05-45762, JP-A-05-45763, JP-A-05-45764, JP-A-05-45765, JP-A-05-94925, and so on.

In applying a hydrazine nucleation agent to photographic materials, the agent is desirably incorporated in a silver halide emulsion layer, but it may be present in a light-insensitive hydrophilic colloid layer (e.g., a protective layer, an interlayer, a filter layer, an antihalation layer). The amount of a hydrazine nucleation agent added is preferably in the range of $1\times10^{-6}$ to $5\times10^{-2}$ mole, particularly $1\times10^{-5}$ to $2\times10^{-2}$ mole, per mole of silver halide.

In using hydrazine compounds, they are dissolved in an appropriate water-miscible organic solvent, such as alcohols (e.g., methanol, ethanol, propanol, fluorinated alcohols), ketones (e.g., acetone, methyl ethyl ketone), dimethylformamide, dimethyl sulfoxide, methyl cellosolve, or so on.

Also, the hydrazine compounds can be used in the form of dispersion. The dispersion thereof may be prepared, e.g., according to the well-known emulsion dispersion method, wherein the hydrazine compounds are dissolved using an oil, such as dibutyl phthalate, tricresyl phosphate, glyceryl triacetate, diethyl phthalate or so on, and an auxiliary solvent such as ethyl acetate, cyclohexanone or so on, and then mechanically emulsified to prepare the dispersion. In accordance with the method known as solid dispersion method, on the other hand, the dispersion may be prepared by dispersing a powder of hydrazine compound into water by means of a ball mill, a colloid mill or ultrasonic waves.

It is preferable for the silver halide photographic materials to contain a nucleation accelerator, such as an amine derivative, an onium salt, a disulfide derivative, a hydroxylmethyl derivative, an acetylene derivative, a urea derivative or so on, in silver halide emulsion layers or other hydrophilic colloid layers.

As examples of amine derivatives, mention may be made of the compounds described, e.g., in JP-A-60-140340, JP-A-62-50829, JP-A-62-222241, JP-A-62-250439, JP-A-62-280733, JP-A-63-124045, JP-A-63-133145, JP-A-63-286840. Preferable amine derivatives include the compounds having groups capable of adsorbing onto silver halide grains as described, e.g., in JP-A-63-124,045, JP-A-63-133,145 and JP-A-63-286,840, the compounds containing at least 20 carbon atoms as described, e.g., in JP-A-62-222241, the amine compounds as described, e.g., in U.S. Patent 4,975,354 and EP-A-0458706, and the compounds described in JP-A-62-50829.

As for the onium salts, pyridinium salts, ammonium salts and phosphonium salts are suitable examples thereof. Preferable pyridinium salts include the compounds described in JP-A-6-242534. Preferable ammonium salts include the compounds described, e.g., in JP-A-62-250439 and JP-A-62-280733. Preferable phosphonium salts include the compounds described, e.g., in JP-A-61-167939, and JP-A-62-270733.

As for the disulfide derivatives, the compounds described in JP-A-61-198147 are examples thereof.

As for the hydroxymethyl derivatives, the compounds described, e.g., in U.S. Pat. Nos. 4,698,956 and 4,777,118, European Patent No. 231,859 and JP-A-62-50829 are examples thereof. In particular, diarylmethacrinol derivatives are preferred over the others.

As for the acetylene derivatives, the compounds described, e.g., in JP-A-03-168735 and JP-A-02-271351 are examples thereof.

As for the urea derivatives, the compounds described, e.g., in JP-A-03-168736 are examples thereof.

These nucleation accelerators have their individual addition amounts determined as optimum depending on the species thereof, but it is desirable that each addition amount be in the range of $1.0\times10^{-2}$ to $1.0\times10^{2}$ moles, preferably $1.0\times10^{-1}$ to $5.0\times10$ moles, per mole of hydrazine compound.

In using those compounds, they are dissolved in an appropriate water-miscible organic solvent, such as alcohols (e.g., methanol, ethanol, propanol, fluorinated alcohols), ketones (e.g., acetone, methyl ethyl ketone), dimethylformamide, dimethyl sulfoxide, methyl cellosolve, or so on.

Also, such compounds can be used in the form of dispersion. The dispersion thereof may be prepared, e.g., according to the well-known emulsion dispersion method, wherein the hydrazine compounds are dissolved using an oil, such as dibutyl phthalate, tricresyl phosphate, glyceryl triacetate, diethyl phthalate or so on, and an auxiliary solvent such as ethyl acetate, cyclohexanone or so on, and then mechanically emulsified to prepare the dispersion. In accordance with the method known as solid dispersion method, on the other hand, the dispersion may be prepared by dispersing a powder of the foregoing compound into water by means of a ball mill, a colloid mill or ultrasonic waves.

As development accelerators suitable for the aforementioned ultra-hard gradation system or accelerators for nucleation infectious development, not only the compounds disclosed, e.g., in JP-A-53-77616, JP-A-54-37732, JP-A-137133, JP-A-60-140340 and JP-A-60-14959 but also various compounds containing a nitrogen or sulfur atom are effective.

The most appropriate addition amount of such an accelerator depends on the species thereof, but it is desirably in the range of $1.0—10^{-3}$ to 0.5 g/m$^2$, especially $5.0\times10^{-3}$ to 0.1 g/m$^2$.

In addition, a redox compound capable of releasing a development inhibitor can be used in the ultra-hard gradation system described above. As examples of such a redox compound, mention may be made of the compounds described, e.g., in JP-A-02-293736, JP-A-02-308239, JP-A-01-154060 and JP-A-01-205885. The amount of the redox compound used is desirably in the range of $1\times10^{-6}$ to $5\times10^{-2}$ mole, particularly $1\times10^{-5}$ to $1\times10^{-2}$ mole, per mole of silver halide.

The photographic emulsion layers or other hydrophilic colloid layers of photographic materials may contain various surfactants, for a wide variety of purposes, such as coating aids, prevention of electrification, improvement of slipping properties, emulsification and dispersing, prevention of adhesion, and improvement of photographic characteristics (e.g., development acceleration, hard gradation enhancement, and sensitization) and so on.

Examples of surfactants which can be employed include nonionic surfactants such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicones), glycidol derivatives (e.g., alkenylsuccinic acid polyglycerides, alkylphenol polyglycerides), fatty acid esters of polyhydric alcohols, alkyl esters of sugars, and so on; anionic surfactants containing acid groups (e.g., a carboxyl group, a sulfo group, a phospho group, a sulfate group, a phosphate group), such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, and so on; amphoteric surfactants such as amino acids, aminoalkylsulfonates, aminoalkylsulfates, aminoalkylphosphates, alkylbetaines, amine oxides, and so on; and cationic surfactants such as alkylamines, aliphatic or aromatic quaternary ammonium salts, heterocyclic quaternary ammonium salts (e.g., pyridinium, imidazolium), aliphatic or hetero ring-containing phosphonium or sulfonium salts, and so on.

As a binder or a protective colloid of the photographic emulsions, gelatin is used to advantage. Also, hydrophilic colloids other than gelatin can be used. For instance, other colloids that can be used include proteins such as gelatin derivatives, graft polymers of gelatin and other high polymers, albumin, casein, etc.; sugar derivatives such as cellulose derivatives (e.g., hydroxyethyl cellulose, carboxymethyl cellulose, cellulose sulfate), sodium alginate, starch derivatives, etc.; and various kinds of synthetic hydrophilic macromolecular substances such as homo- or co-polymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and so on.

As for the gelatin, not only lime-processed gelatin but also acid-processed gelatin, hydrolysis products of gelatin and enzyme-processed gelatin can be used.

It is desirable to incorporate an organic material capable of effusing in the development-processing step into emulsion layers or other hydrophilic colloid layers, especially into those of X-ray sensitive materials. If the effusing material is gelatin, it is desirable to use the gelatin of such a species as not to participate in the cross-linking reaction of gelatin caused by a hardener. For instance, acetylated gelatin and phthaloylated gelatin are examples thereof. Preferably, the molecular weight of such a species of gelatin is not high. As for the high molecular materials other than gelatin, on the other hand, hydrophilic polymers such as the polyacrylamides as described in U.S. Pat. No. 3,271,158, polyvinyl alcohol, polyvinyl pyrrolidone and the like can be used effectively. Also, sugars such as dextran, saccharose, pullulan and the like are effective. Of these organic materials, polyacrylamides and dextran are used to greater advantage, and polyacrylamides are preferred in particular. These materials have preferably an average molecular weight of at most $2\times10^{4}$, especially at most $1\times10^{4}$. An effective rate of effusion due to the processing ranges from 10% to 50% of the total weight of organic materials coated, excluding silver halide grains. Preferably, the effluent material comprises from 15% to 30% of the organic materials coated.

The layer(s) in which the organic materials to effuse during processing are present may be an emulsion layer and/or a surface protecting layer. If the organic materials to be present therein is constant in total amount, it is more desirable to incorporate them into both the surface protecting layer and the emulsion layer than to incorporate them into the emulsion layer alone, and it is most desirable to incorporate them into the surface protecting layer alone. If the emulsion therein has a multilayer structure, it is desirable that an emulsion layer nearer to the surface protecting layer contain the greater amount of organic materials.

Suitable examples of an antistatic agent include the fluorine-containing surfactants described in JP-A-62-109044 and JP-A-62-215272, the nonionic surfactants described, e.g., in JP-A-60-76742, JP-A-60-80846, JP-A-60-80848, JP-A-60-80839, JP-A-60-76741, JP-A-58-208743, JP-A-62-172343, JP-A-62-173459 and JP-A-62-215272, and the conductive polymers or latexes (nonionic, anionic, cationic and amphoteric) described in JP-A-57-204540 and JP-A-62-215272. As for the inorganic antifoggants, the conductive tin oxide, zinc oxide and complex oxides formed by doping those metal oxides with antimony or the like are suitable examples thereof.

Suitable examples of a matting agent, as described in U.S. Pat. Nos. 2,992,101, 2,701,245, 4,142,894 and 4,396,706, include organic compounds such as a homopolymer of methylmethacrylate, a copolymer of methylmethacrylate and methacrylic acid, starch, etc., and fine grains of inorganic compounds such as silica, titanium dioxide, strontium sulfate, barium sulfate, etc. A suitable grain size is in the range of 1.0 to 10 μm, particularly 2 to 5 μm.

The photographic emulsion layers and/or other layers of a silver halide photographic material may contain dyes or colloidal silver for the purpose of causing them to absorb light of specified wavelengths to prevent the halation and irradiation, or for the purpose of providing a filter layer to control the spectral composition of light to be incident upon the photographic emulsion layers. In the both-sided emulsion film such as a medical X-ray film for direct taking, a layer for crossover cut may be arranged below emulsion layers. As examples of dyes used for the aforementioned purposes, mention may be made of oxonol dyes containing a pyrazolone, barbituric or barbituric acid nucleus, azo dyes, azomethine dyes, anthraquinone dyes, arylidene dyes, styryl dyes, triarylmethane dyes, merocyanine dyes, cyanine dyes and so on. These dyes are described below in more detail.

As for the oxonol dyes containing a pyrazolone or barbituric acid nucleus, there are instanced those described, e.g., in British Patents 506,385, 1,177,429, 1,131,884, 1,338,799, 1,385,371, 1,467,214, 1,438,102 and 1,553,516, JP-A-48-85130, JP-A-49-114420, JP-A-52-117123, JP-A-55-161233, JP-A-59-11640, JP-B-39-22069, JP-B-43-13168, JP-B-62-273527, and U.S. Pat. Nos. 3,247,127, 3,469,985 and 4,078,933. Other oxonol dyes which can be used are those described in U.S. Pat. Nos. 2,533,472 and 3,379,533, British Patent 1,278,621, JP-A-01-134447, JP-A-01-183652, and so on. On the other hand, suitable examples of azo dyes include those described in British Patents 575,691, 680,631, 599,623, 786,907, 907,125 and 1,045,609, U.S. Pat. No. 4,255,326, JP-A-59-211043, and so on; suitable examples of azomethine dyes include those described in British Patents 2,014,598 and 750,031, and so on; suitable examples of anthraquinone dyes include those described in U.S. Pat. No. 2,865,752; suitable examples of arylidene dyes include those described in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286, JP-B-59-37303, European Patent 280,252, and so on; suitable examples of styryl dyes include those described in JP-B-28-3082, JP-B-44-16594, JP-B-59-28898, and so on; suitable examples of triarylmethane dyes include those described in British Patents 446,538 and 1,335,422, JP-A-59-228250, and so on; suitable examples of merocyanine dyes include those described in British Patents 1,075,653, 1,153,341, 1,284,730, 1,475,228 and 1,542,807, and so on; and suitable examples of cyanine dyes include those described in U.S. Pat. Nos. 2,843,486 and 3,294,539, JP-A-62-123454, JP-A-01-291247, and so on.

In order to inhibit those dyes from diffusing, there can be adopted methods as described below. For instance, a method in which a ballast group is introduced into a dye to render the dye nondiffusible can be employed.

Another applicable method is disclosed, e.g., in U.S. Pat. Nos. 2,548,564, 4,125,386 and 3,625,694, wherein an anionic dye-containing layer further contains as a mordant a hydrophilic polymer opposite in charge to the dissociated anionic dye, thereby localizing the dye in the definite layer through the interaction between the dye molecule and the hydrophilic polymer molecule.

As for the hydrophilic polymer used therein, anion exchange polymers are preferred. Various known quaternary ammonium-salt (or phosphonium-salt) polymers can be used as the anion exchange polymers. Quaternary ammonium salts of polymers are widely known as polymeric mordant or antistatic agent by the publications as cited below. Specific examples thereof include the aqueous dispersion latexes described in JP-A-59-166940, U.S. Pat. No. 3,958,995, JP-A-55-142339, JP-A-54-126027, JP-A-54-155835, JP-A-53-30328 and JP-A-54-92274; the polyvinyl pyridinium salts described in U.S. Pat. Nos. 2,548,564, 3,148,061 and 3,756,814; the water-soluble quaternary ammonium salts of polymers described in U.S. Pat. No. 3,709,690; and the water-insoluble quaternary ammonium salts of polymers described in U.S. Pat. No. 3,898,088.

In particular, it is advantageous to use hydrophilic polymers as cited above in the form of aqueous latex prepared by copolymerizing constituent monomers of such hydrophilic polymers with monomers having at least two (preferably two to four) ethylenically unsaturated groups and cross-linking the copolymers obtained, lest they move from the intended layer to other layers or processing solutions to produce photographically undesirable effects.

A still another applicable method in which a specific layer is dyed with a water-insoluble solid dye is disclosed, e.g., in JP-A-56-12639, JP-A-55-155350, JP-A-55-155351, JP-A-63-27838, JP-A-63-197943, JP-A-02-297543, JP-A-03-167546, JP-A-04-127143, European Patent 15,601, and WO 88/04794.

Further applicable method in which a specific layer is dyes with fine grains of a dye-adsorbed metal salt is disclosed, e.g., in U.S. Pat. Nos. 2,719,088, 2,496,841 and 2,496,843, and JP-A-60-45237.

The photographic materials can contain a wide variety of compounds for the purpose of prevention of fogging and stabilization of photographic functions during production, storage or photographic processing. More specifically, azoles such as benzothiazolium salts, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles, nitrobenzotriazoles and so on; mercaptopyrimidines; mercaptotriazines; thioketo compounds such as oxazolinethione; azaindenes such as triazaindenes, tetrazaindenes (especially (1,3,3a,7)tetrazainenes substituted with a hydroxy group at the 4-position), pentazaindenes and so on; and other many compounds known as an antifoggant or a stabilizer, such as benzenethiosulfonic acid, benzenesulfinic acid, benzenesulfonic acid amide and so on, can be added to the photographic materials. Of these compounds, benzotriazoles (e.g., 5-methyl-benzotriazole) and nitroindazoles (e.g., 5-nitroindazole) are preferred over the others. Also, those compounds may be added to processing solutions. In addition, the photographic material can contain the compounds described in JP-A-62-30243, which release an inhibitor during development, as a stabilizer or with the purpose of prevention of black spots.

Further, the photographic materials can contain a developing agent, such as a hydroquinone derivative, a phenidone derivative or the like, as a stabilizer, an accelerator or for other purposes.

The photographic emulsion layers or other hydrophilic colloidal layers of the photographic materials applicable to the present invention may contain inorganic or organic hardeners. Examples of hardeners that can be used include chrome salts (e.g., chrome alum, chromium acetate), aldehydes (e.g., formaldehyde, glutaraldehyde), N-methylol compounds (e.g., dimethylol urea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) and mucohalogen acids (e.g., mucochloric acid). These hardeners may be used alone or as a combination of two or more thereof.

Furthermore, the photographic emulsion layers and other hydrophilic colloid layers of the photographic materials may contain hydroquinone derivatives capable of releasing a development inhibitor depending on the density of developed image (or the so-called DIR-hydroquinones).

Specific examples of such a hydroquinone derivative include the compounds described in U.S. Patents 3,379,529, 3,620,746, 4,377,634 and 4,332,878, JP-A-49-129536, JP-A-54-67419, JP-A-56-153336, JP-A-56-153342, JP-A-59-278853, JP-A-59-90435, JP-A-59-90436, JP-A-59-138808, and so on.

The photographic materials can contain a dispersion of synthetic polymer insoluble or slightly soluble in water in order to enhance the dimensional stability. Examples of a synthetic polymer which can be used include alkyl-(meth)acrylates, alkoxyacryl(meth)acrylates, glycidyl-(meth)acrylates and polymers prepared from the acrylates as cited above and acrylic acid, methacrylic acid or so on. These synthetic polymers may be used alone or as a combination of two or more thereof.

It is desirable that an acid group-containing compound be present in silver halide emulsion layers and other layers of the photographic materials. As examples of an acid group-containing compound, mention may be made of organic acids such as salicylic acid, acetic acid, ascorbic acid, etc., and homo- and co-polymers containing acid monomers, e.g., acrylic acid, maleic acid, phthalic acid, etc., as constitutional repeating units. For details of these compounds the descriptions in JP-A-61-223834, JP-A-61-228437, JP-A-62-25745 and JP-A-62-55642 can be referred to. Of those compounds, the most favorable low molecular weight compound is ascorbic acid, while the most favorable high molecular weight compound is the water dispersible latex of a copolymer prepared from an acid monomer, such as acrylic acid, and a cross-linking monomer having at least two unsaturated groups, such as divinylbenzene.

The thus prepared silver halide emulsions are applied to a support, such as a cellulose acetate film, a polyethylene terephthalate film, etc., using a dip method, an air knife method, a bead method, an extrusion doctor method, a both-sided coating method or so on, and then dried.

Other examples of a support which can be used in the photographic materials include flexible supports such as a paper sheet laminated with an α-olefin polymer (e.g., polyethylene, polypropylene, ethylene/butene copolymer), a synthetic paper sheet, etc., and metal sheets. Of the supports cited above, a polyethylene terephthalate film is preferred over the others. As examples of a subbing layer which can be used in the present invention, mention may be made of the subbing layer described in JP-A-59-3972 which is formed by the treatment with an organic solvent containing polyhydroxybenzenes, and the subbing layers described in JP-A-49-11118 and JP-A-52-10491 which are formed by the treatment with aqueous latexes. In general, the subbing layer formed can be further subjected to a chemical or physical surface treatment. As for the surface treatment, surface activation treatments including treatments with chemicals, mechanical treatments, corona discharge treatments and so on are examples thereof.

The present invention can be applied to color photographic materials. In this case, various color couplers can be used. The term "color couplers" as used herein refers to the compounds capable of producing dyes by the coupling reaction with an oxidized aromatic primary amine developing agent. Typical representatives of useful color couplers are naphthol or phenol compounds, pyrazolone or pyrazoloazole compounds, and open-chain or heterocyclic ketomethylene compounds. Specific examples of these cyan, magenta and yellow couplers which can be used in the present invention are described in the patents quoted in *Research Disclosure*, RD-17643 (December 1978) Item VII-D and ibid., RD-18717 (November 1979).

A wide variety of additives can be used in the present invention without any particular restriction. For instance, various additives described in the references cited below can be employed.

| Mentioned Item | Reference (place of description) |
|---|---|
| 1) Chemical Sensitizer | RESEARCH DISCLOSURE 17643, page 23<br>RESEARCH DISCLOSURE 18716, page 648, right column<br>JP-A-02-68539, page 10<br>JP-A-5-313282 |
| 2) Sensitivity Improver | RESEARCH DISCLOSURE 18716, page 648, right column |
| 3) Spectral Sensitizer and Supersensitizer | RESEARCH DISCLOSURE 17643, pages 23–24<br>RESEARCH DISCLOSURE 18716, page 648, right column<br>JP-A-02-68539, pages 4–8<br>JP-A-02-12236, page 8<br>JP-A-02-103536, pages 16–17<br>JP-A-01-112235, JP-A-02-124560, JP-A-03-7928, and JP-A-05-11389 |
| 4) Brightening Agent | RESEARCH DISCLOSURE 17643, page 24 |
| 5) Antifoggant and Stabilizer | RESEARCH DISCLOSURE 17643, pages 24–25<br>RESEARCH DISCLOSURE 18716, page 649, right column<br>JP-A-02-68539, pages 3–4 and 10–11<br>JP-A-02-103536, pages 17–18<br>JP-A-01-237538 (Thiosulfinic acids) |

-continued

| Mentioned Item | Reference (place of description) |
|---|---|
| 6) Light Absorbent, Filter Dye, and UV Absorbent | RESEARCH DISCLOSURE 17643, pages 25–26<br>RESEARCH DISCLOSURE 18716, page 649, right column, to page 650, left column |
| 7) Stain Inhibitor | RESEARCH DISCLOSURE 17643, page 25<br>RESEARCH DISCLOSURE 18716, page 650, left column to right column |
| 8) Dye Image Stabilizer | RESEARCH DISCLOSURE 17643, page 25 |
| 9) Hardener | RESEARCH DISCLOSURE 17643, page 26<br>RESEARCH DISCLOSURE 18716, page 651,left column<br>JP-A-02-68539, pages 12–13<br>JP-A-02-103536, page 18 |
| 10) Binder | RESEARCH DISCLOSURE 17643, page 26<br>RESEARCH DISCLOSURE 18716, page 651, left column<br>JP-A-02-18542, page 3 |
| 11) Tone Improver | JP-A-62-276539, pages 2–10<br>JP-A-03-94249, pages 6–11 |
| 12) Surfactant and Antistatic Agent | JP-A-02-68539, pages 11–12<br>JP-A-02-12236, page 9<br>JP-A-02-18542, pages 2–4 |
| 13) Matting Agent, Lubricant and Plasticizer | JP-A-02-68539, pages 12–14<br>JP-A-02-103536, page 18 |
| 14) Hydrophilic Colloid | JP-A-02-68539, page 12 |
| 15) Crossover Cut | JP-A-02-264944, pages 4–14 |
| 16) Dye and Mordant | JP-A-02-68539, pages 13–14<br>JP-A-03-24537, pages 14–16<br>JP-A-02-103536, pages 17–18<br>JP-A-02-294638 and JP-A-03-185773 (Solid dyes) |
| 17) Polyhydroxy-benzenes | JP-A-03-3-9948, pages 11–12<br>EP-A-0452772 |
| 18) Hydrazine Nucleation Agent | JP-A-02-12236, pages 2–7<br>JP-A-03-174143, pages 20–27 |
| 19) Nucleation Accelerator | JP-A-02-103536, pages 9–16<br>JP-A-01-179939 |
| 20) Silver Halide Emulsion and Preparation Method Thereof | JP-A-02-97037, pages 20–21<br>JP-A-02-103536, pages 16–17<br>JP-A-05-11389 (Selenium compounds) |
| 21) Polymer Latex | JP-A-02-103536, page 18 |
| 22) Acid Group Containing Compound | JP-A-02-103536, page 18 |
| 23) Black-Spots Inhibitor | U.S. Pat. No. 4,956,257<br>JP-A-02-118832 |
| 24) Redox Compound | JP-A-02-301743 (Compounds of general formula (I))<br>JP-A-03-174143, pages 3–20<br>JP-A-05-257239 and JP-A-5-257389 |
| 25) Monomethine Compound | JP-A-02-287532 (Compounds of general formula (II)) |

The present invention will now be illustrated in more detail by reference to the following examples. However, the invention should not be construes as being limited to these examples.

EXAMPLE 1

Preparation of Emulsion

Nucleation was carried out as follows: In accordance with a double jet method, 0.13M aqueous solution of silver nitrate and an aqueous halide solution containing $1.5\times10^{-7}$ mole/mole silver of $K_2Rh(H_2O)Cl_5$, $2\times10^{-7}$ mole/mole silver of $K_3IrCl_6$, 0.04M potassium bromide and 0.09M sodium chloride were added to an aqueous gelatin solution containing sodium chloride and 1,3-dimethyl-2-imidazolidinethione at 38° C. over a 12-minute period with agitating, thereby forming silver chlorobromide grains having an average grain size of 0.14 μm and a chloride content of 70 mole %.

Thereto were then added 0.87M aqueous solution of silver nitrate and an aqueous halide solution containing $2\times10^{-5}$ mole/mole silver of $K_3Fe(CN)_6$, 0.26M potassium bromide and 0.65M sodium chloride over a 20-minute period according to the double jet method under the same condition as described above.

The emulsion thus prepared was admixed with a solution containing $1\times10^{-3}$ mole of KI to undergo conversion, and then washed in the usual way, or using a flocculation method. Further, the resulting emulsion was admixed with 40 g/mole silver of gelatin, and adjusted to pH 5.3 and pAg 8.5. Thereafter, the emulsion was chemically sensitized at 55° C. by the addition of 1 mg of sodium thiosulfate, 1 mg of Compound (SE-1) illustrated below, 4 mg of chloroauric acid and 10 mg of sodium thiosulfonate so that the optimum sensitivity might be achieved. In addition, 150 mg of 4-hydroxy-6-methyl-1,3,3a,7-tetrazaindene as a stabilizer and 100 mg of Proxel as a preservative were added thereto. The thus prepared emulsion grains were silver iodochlorobromide grains having a cubic crystal form, an average grain size of 0.25 μm and a chloride content of 69.9 mole % (variation coefficient: 10%).

SE-1

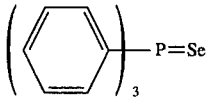

Preparation of Coated Sample

To the emulsion obtained were added $3\times10^{-4}$ mole/mole Ag of a sensitizing dye illustrated below, 75 mg/mole Ag of sodium 4,4,'-bis(4,6-naphthoxy-pyrimidine-2-ylamino)stilbenedisulfonate as a supersensitizing agent, the compounds of formulae (a) and (b) illustrated below in each amount of $4\times10^{-4}$ mole/mole Ag, 300 mg/mole Ag of the hydrazine derivative of formula (c), 200 mg/mole Ag of the accelerator of formula (d), 100 mg/mole Ag of the accelerator of formula (e), and further a polyethylacrylate latex and 1,3-divinylsulfonyl-2-propanol as a hardener. The resulting emulsion was applied to a polyethylene terephthalate film having a moisture-proof layer as an undercoat, in which a vinylidene chloride copolymer was present, so that it might have a silver coverage rate of 3.5 g/m$^2$.

Sensitizing Dye

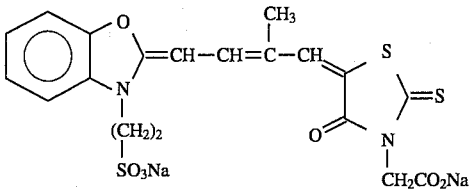

(a)

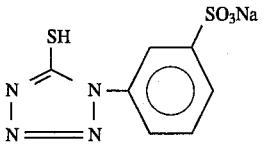

(b)

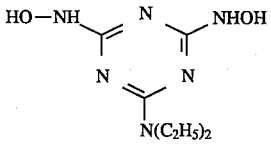

(c)

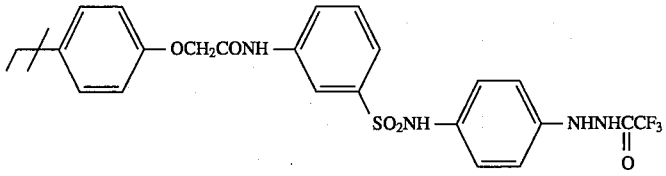

(d)

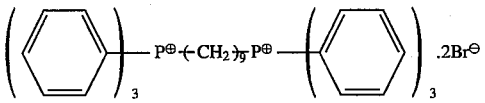

(e)

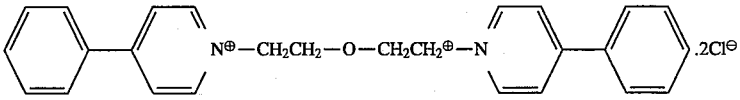

The thus formed emulsion layer was coated with a protective layer constituted of 1.0 g/m$^2$ of gelatin, 40 mg/m$^2$ of an unstable-type $SiO_2$ matting agent having an average particle size of about 3.5 μm, 0.1 g/m$^2$ of methanol silica, mg/m$^2$ of polyacrylamide, 5 mg/m$^2$ of sodium ethylthiosulfonate, 200 mg/m$^2$ of hydroquinone, 20 mg/m$^2$ of silicone oil, and as coating aids 5 mg/m$^2$ of a fluorine-containing surfactant of the following formula (f) and 100 mg/m$^2$ of sodium dodecylbenzenesulfonate. Further, the other surface of the polyethylene terephthalate film was coated with a backing layer and a back protecting layer having the following compositions respectively. Thus, the preparation of a sample film was completed.

(f) $C_8F_{17}SO_2N-\underset{\underset{C_3H_7}{|}}{CH}-COOK$

[Composition of Backing Layer]

| | |
|---|---|
| Gelatin | 3 g/m$^2$ |
| Polyethylacrylate latex | 2 g/m$^2$ |
| Sodium p-dodecylbenzenesulfonate (surfactant) | 40 g/m$^2$ |
| $CH_2=CHSO_2CH_2CONH-$ / $(CH_2)_2$ / $CH_2=CHSO_2CH_2CONH-$ | 110 mg/m$^2$ |
| $SnO_2$/Sb (90/10 by weight, average grain size: 0.20 μm) | 200 mg/m$^2$ |
| Mixture of Dye (g), Dye (h) and Dye (i) | |
| Dye (g) | 50 mg/m$^2$ |

-continued

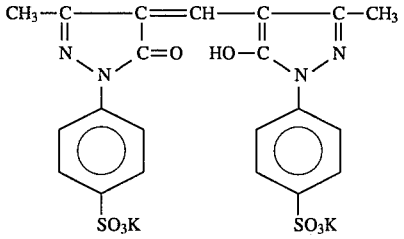

Dye (h) 50 mg/m²

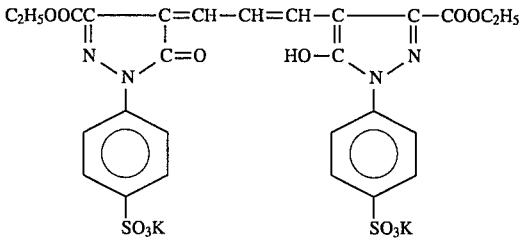

Dye (i) 150 mg/m²

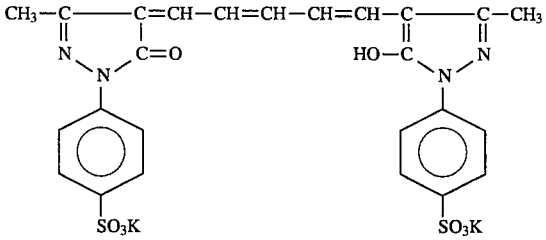

[Composition of Back Protecting Layer]

| | |
|---|---|
| Gelatin | 0.8 g/m² |
| Fine particles of polymethylmethacrylate (average particle size: 4.5 μm) | 30 mg/m² |
| Sodium dihexyl-α-sulfosuccinate | 15 mg/m² |
| Sodium p-dodecylbenzenesulfonate | 15 mg/m² |
| Sodium acetate | 40 mg/m² |

[Composition of Developer]

| | |
|---|---|
| Diethylenetriaminepentaacetic acid | 1.5 g |
| Potassium carbonate | 50 g |
| Potassium bromide | 3 g |
| 5-Methylbenzotriazole | 0.1 g |
| 1-Phenyl-5-mercaptotetrazole | 0.02 g |
| Potassium sulfite | 42 g |
| 4-Hydroxymethyl-4-methyl-1-phenyl-3-pyrazolidone | 0.4 g |
| Compound of formula (A) as shown in Table 1 | 0.25 mole/l |
| Compound of formula (B) or (C) as shown in Table 1 | 0.20 mole/l |
| Water to make | 1 liter |

The developer was adjusted to pH 10.7 by the addition of sodium hydroxide.

A 500 ml portion of each of the foregoing developers was placed in a 1000 ml beaker, and the beaker was covered with a wrapping film, Saran Wrap (trade name, a product of Asahi Chemical Industry Co., Ltd.). Holes measuring 2 mm in diameter were made in the covering film, and the developer was allowed to stand for 10 days at room temperature. The thus aged developer was examined for the remaining rate of the compound represented by formula (A) and pH value. The results obtained are shown in Table 1.

TABLE 1

| No. | Compound of Formula (A) added to Developer | Compound of Formula (B) or (C) added to Developer | pH | Remaining Rate of Compound of Formula (A) in Developer after 10 Days' Aging | Note |
|---|---|---|---|---|---|
| 1 | A-1 | — | 9.92 | 58% | comparison |
| 2 | A-1 | $NH_2OH$ | 9.86 | 50% | comparison |

TABLE 1-continued

| No. | Compound of Formula (A) added to Developer | Compound of Formula (B) or (C) added to Developer | pH | Remaining Rate of Compound of Formula (A) in Developer after 10 Days' Aging | Note |
|---|---|---|---|---|---|
| 3 | A-1 | B-9 | 10.38 | 86% | invention |
| 4 | A-1 | B-19 | 10.27 | 78% | invention |
| 5 | A-1 | B-20 | 10.40 | 86% | invention |
| 6 | A-1 | B-50 | 10.24 | 75% | invention |
| 7 | A-1 | C-10 | 10.32 | 80% | invention |
| 8 | A-1 | C-15 | 10.26 | 79% | invention |
| 9 | A-6 | — | 9.91 | 48% | comparison |
| 10 | A-6 | $NH_2OH$ | 9.79 | 42% | comparison |
| 11 | A-6 | B-1 | 10.50 | 88% | invention |
| 12 | A-6 | B-4 | 10.42 | 86% | invention |
| 13 | A-6 | B-5 | 10.39 | 84% | invention |
| 14 | A-6 | B-17 | 10.30 | 75% | invention |
| 15 | A-6 | C-6 | 10.32 | 78% | invention |
| 16 | A-6 | C-23 | 10.24 | 70% | invention |
| 17 | A-19 | — | 9.84 | 52% | comparison |
| 18 | A-19 | B-9 | 10.20 | 70% | invention |
| 19 | A-19 | B-19 | 10.25 | 75% | invention |
| 20 | A-19 | B-27 | 10.23 | 72% | invention |
| 21 | A-19 | B-37 | 10.31 | 74% | invention |
| 22 | A-19 | C-14 | 10.27 | 75% | invention |
| 23 | A-34 | — | 9.95 | 50% | comparison |
| 24 | A-34 | B-6 | 10.39 | 80% | invention |
| 25 | A-34 | B-11 | 10.31 | 72% | invention |
| 26 | A-34 | B-30 | 10.22 | 64% | invention |
| 27 | A-34 | C-9 | 10.25 | 66% | invention |
| 28 | A-43 | — | 9.92 | 49% | comparison |
| 29 | A-43 | B-1 | 10.36 | 78% | invention |
| 30 | A-43 | B-12 | 10.38 | 88% | invention |
| 31 | A-43 | B-28 | 10.32 | 76% | invention |
| 32 | A-43 | C-23 | 10.23 | 70% | invention |
| 33 | A-49 | — | 9.90 | 52% | comparison |
| 34 | A-49 | B-5 | 10.26 | 80% | invention |
| 35 | A-49 | B-16 | 10.37 | 86% | invention |
| 36 | A-49 | B-23 | 10.25 | 79% | invention |
| 37 | A-49 | C-1 | 10.21 | 70% | invention |

The sample films prepared in the aforementioned manner were each exposed through an interference filter having a peak at 633 nm and a step wedge by means of a xenon flash lamp having an emission time of $10^{-5}$ second. One group of the thus exposed sample films were developed at 35° C. for 30 seconds with the above-described fresh developers respectively, and the other group with the above-described aged developers respectively. Then, each of the thus developed sample films was subjected successively to fixation, washing and drying processings. The fixer used therein was GR-F1 (trade name, products of Fuji Photo Film Co., Ltd.).

The sensitivity was expressed in terms of the reciprocal of an exposure amount providing a density of 1.5. According to this expression, the greater the value obtained, the higher the sensitivity. The sensitivities shown in Table 2 are relative values. As for the indication of an image contrast, there was adopted the $\gamma$ value defined as the slope of a straight line connecting the density point of fog +0.3 and the density point of fog +3.0 on a characteristic curve, that is, $\gamma=(3.0-0.3)/[\log(\text{exposure amount providing the density of } 3.0)-\log(\text{exposure amount providing the density of } 0.3)]$. Accordingly, the $\gamma$ values shown in Table 2 signify that photographic characteristics are harder the greater those values are.

The thus processed sample films were each examined for generation of black spots (pepper fog) by microscopic observation. An evaluation was made by grading them by the extent of black- spot generation in accordance with the following criterion: The grade "5" represents the best level with respect to the black-spot generation, namely a state such that the generation of black spots is not observed at all; the grade "1" represents the worst level with respect to the black-spot generation, namely a state such that considerable generation of black spots is observed, and the grade "3" represents the practically allowable level with respect to the black-spot generation.

The examination results obtained are shown in Table 2.

TABLE 2

| No. | Compound of formula (A) added to Developer | Compound of Formula (B) or (C) added to Developer | Developer used | Photographic Properties: Sensitivity | Gradation | Black spots | Note |
|---|---|---|---|---|---|---|---|
| 1 | A-1 | — | fresh | 100 | 19.0 | 5 | comparison |
| | | | aged | 76 | 7.9 | 2 | |
| 2 | A-1 | $NH_2OH$ | fresh | 100 | 19.0 | 5 | comparison |
| | | | aged | 74 | 7.4 | 2 | |
| 3 | A-1 | B-9 | fresh | 100 | 19.2 | 5 | invention |
| | | | aged | 92 | 18.0 | 4 | |
| 4 | A-1 | B-19 | fresh | 100 | 18.8 | 5 | invention |
| | | | aged | 95 | 18.0 | 4 | |
| 5 | A-1 | B-20 | fresh | 100 | 19.5 | 5 | invention |
| | | | aged | 91 | 17.0 | 5 | |
| 6 | A-1 | B-50 | fresh | 100 | 19.1 | 5 | invention |
| | | | aged | 90 | 17.2 | 4 | |
| 7 | A-1 | C-10 | fresh | 100 | 18.9 | 5 | invention |
| | | | aged | 91 | 17.5 | 5 | |
| 8 | A-1 | C-15 | fresh | 100 | 19.2 | 5 | invention |
| | | | aged | 90 | 18.0 | 4 | |
| 9 | A-6 | — | fresh | 100 | 19.0 | 5 | comparison |
| | | | aged | 72 | 7.7 | 2 | |
| 10 | A-6 | $NH_2OH$ | fresh | 100 | 18.9 | 5 | comparison |
| | | | aged | 70 | 7.6 | 2 | |
| 11 | A-6 | B-1 | fresh | 100 | 19.1 | 5 | invention |
| | | | aged | 91 | 17.1 | 4 | |
| 12 | A-6 | B-4 | fresh | 100 | 18.4 | 5 | invention |
| | | | aged | 92 | 17.2 | 4 | |

TABLE 2-continued

| No. | Compound of formula (A) added to Developer | Compound of Formula (B) or (C) added to Developer | Developer used | Photographic Properties Sensitivity | Gradation | Black spots | Note |
|---|---|---|---|---|---|---|---|
| 13 | A-6 | B-5 | fresh | 100 | 18.8 | 5 | invention |
| | | | aged | 91 | 17.0 | 4 | |
| 14 | A-6 | B-17 | fresh | 100 | 19.1 | 5 | invention |
| | | | aged | 90 | 17.4 | 5 | |
| 15 | A-6 | c-6 | fresh | 100 | 19.0 | 5 | invention |
| | | | aged | 95 | 18.0 | 5 | |
| 16 | A-6 | C-23 | fresh | 100 | 18.6 | 5 | invention |
| | | | aged | 92 | 17.0 | 4 | |
| 17 | A-19 | — | fresh | 100 | 19.0 | 5 | comparison |
| | | | aged | 74 | 7.8 | 2 | |
| 18 | A-19 | B-9 | fresh | 100 | 19.2 | 5 | invention |
| | | | aged | 95 | 18.0 | 5 | |
| 19 | A-19 | B-19 | fresh | 100 | 18.8 | 5 | invention |
| | | | aged | 92 | 17.5 | 5 | |
| 20 | A-19 | B-27 | fresh | 100 | 19.5 | 5 | invention |
| | | | aged | 91 | 17.0 | 4 | |
| 21 | A-19 | B-37 | fresh | 100 | 18.6 | 5 | invention |
| | | | aged | 92 | 17.7 | 4 | |
| 22 | A-19 | C-14 | fresh | 99 | 19.2 | 5 | invention |
| | | | aged | 90 | 17.1 | 5 | |
| 23 | A-34 | — | fresh | 98 | 18.6 | 5 | comparison |
| | | | aged | 72 | 7.9 | 2 | |
| 24 | A-34 | B-6 | fresh | 100 | 18.4 | 5 | invention |
| | | | aged | 92 | 18.0 | 5 | |
| 25 | A-34 | B-11 | fresh | 100 | 18.8 | 5 | invention |
| | | | aged | 91 | 17.2 | 4 | |
| 26 | A-34 | B-30 | fresh | 100 | 18.9 | 5 | invention |
| | | | aged | 92 | 17.1 | 5 | |
| 27 | A-34 | C-9 | fresh | 98 | 18.9 | 5 | invention |
| | | | aged | 89 | 17.0 | 4 | |
| 28 | A-43 | — | fresh | 100 | 19.0 | 5 | comparison |
| | | | aged | 72 | 7.7 | 2 | |
| 29 | A-43 | B-1 | fresh | 99 | 18.8 | 5 | invention |
| | | | aged | 91 | 17.0 | 4 | |
| 30 | A-43 | B-12 | fresh | 100 | 19.2 | 5 | invention |
| | | | aged | 92 | 17.4 | 5 | |
| 31 | A-43 | B-28 | fresh | 100 | 19.2 | 5 | invention |
| | | | aged | 91 | 18.0 | 5 | |
| 32 | A-43 | C-23 | fresh | 100 | 18.9 | 5 | invention |
| | | | aged | 90 | 17.2 | 4 | |
| 33 | A-49 | — | fresh | 100 | 19.0 | 5 | comparison |
| | | | aged | 78 | 7.6 | 2 | |
| 34 | A-49 | B-5 | fresh | 98 | 18.8 | 5 | invention |
| | | | aged | 90 | 17.2 | 4 | |
| 35 | A-49 | B-16 | fresh | 100 | 19.5 | 5 | invention |
| | | | aged | 92 | 17.6 | 4 | |
| 36 | A-49 | B-23 | fresh | 100 | 19.2 | 5 | invention |
| | | | aged | 92 | 17.0 | 5 | |
| 37 | A-49 | C-1 | fresh | 100 | 18.9 | 5 | invention |
| | | | aged | 89 | 17.0 | 4 | |

As can be seen from Table 1, when the compound of formula (B) or (C) was present in the developer containing as a developing agent an ascorbic acid or its derivative represented by formula (A), the ascorbic acid or the derivative thereof underwent a small extent of deterioration by aging, and the pH of the developer was lowered by aging to a small extent, too. Further, it can be seen from Table 2, wherein comparisons can be made between photographic properties obtained by using fresh and aged developers respectively, that the developers in which any of the present compounds was not present caused a considerable drop in the sensitivity and a soft-gradation enhancement by the aging. In addition, those developers caused the black-spot generation below the practically allowable level when they underwent the aging. On the other hand, excellent photographic properties, including high sensitivity, high gradation and slight black-spot generation, were obtained using the developers in which the present compounds were present even after those developers underwent the aging. In other words, it is hard to expect that the deterioration of the developing agent by aging and the lowering of the pH of the developer by aging can be suppressed by the addition of the present compound of formula (B) or (C) to the developer containing as a developing agent an ascorbic acid or its derivative represented by formula (A), and it is surprising that the present compounds have a significant effect on the prevention of black-spot generation.

EXAMPLE 2

Preparation of Emulsion A

An aqueous gelatin solution in a volume of 1,200 ml (containing 18 g of deionized, alkali-treated ossein gelatin having a methionine content of about 40 micromole/g, and adjusted to pH 4.3) was placed in a reaction vessel, and kept at 38° C. Thereto, 12 ml portions of Solution Ag-1 (containing, per 100 ml, 20 g of $AgNO_3$, 0.8 g of the foregoing gelatin and 0.2 ml of a 1N $HNO_3$) and Solution X-1 (containing, per 100 ml, 16.9 g of NaCl, 0.8 g of the foregoing gelatin and 0.3 ml of a 1N NaOH) were simultaneously added at a speed of 24 ml/min., followed by 2 minutes agitation. Further, 20 ml portions of Solution Ag-2 (containing, per 100 ml, 2 g of $AgNO_3$, 0.8 g of the foregoing gelatin and 0.2 ml of 1N $HNO_3$) and Solution X-2 (containing, per 100 ml, 1.4 g of KBr, 0.8 g of the foregoing gelatin and 0.2 ml of 1 NaOH) were added simultaneously at a speed of 31 ml/min., followed by 2 minutes agitation. Furthermore, 36 ml portions of Solution Ag-1 and Solution X-1 were added simultaneously at a speed of 48 ml/min. In addition, 20 ml of Solution NaCl-1 (containing 10 g of NaCl per 100 ml) was added. The resulting emulsion was adjusted to pH 4.8, and heated up to 75° C., and aged for 20 minutes. Then, the temperature was lowered to 60° C., and the pH was adjusted,to 5.0. Thereafter, Solution Ag-3 (containing 10 g of $AgNO_3$ per 100 ml) and Solution X-3 (containing 3.6 g of NaCl per 100 ml) were added under an Ag potential of 130 mV in accordance with a controlled double jet method. The flow rate at the beginning of the addition was 7 ml/min., and it was increased by 0.1 ml every one minute. The amount of Solution Ag-3 added was 400 ml.

Subsequently thereto, 0.059 mole of AgBr fine grains having an average grain size of 0.04 μm were added over a period of 5 minutes. Thereafter, 8.5 ml of a 2N potassium thiocyanate solution was added to complete the grain formation.

The thus obtained grains were tabular grains having (100) faces as main surfaces, which were rectangular or square in shape, and they were chloride-rich grains having a bromide content of 17.3 mole %.

The thus prepared emulsion was admixed with a sedimentation agent, cooled to 30° C., washed by sedimentation, admixed with an aqueous solution of gelatin, and then adjusted to pH 6.2 and pCl 13.0 at 38° C. A small portion of the resulting emulsion was withdrawn and the grains therein were observed by electron micrography. Crystal-shape characteristics of the emulsion grains obtained were as follows: The ratio of the total projected area of (100) tabular grains having an aspect ratio of at least 2 to the total projected area of the whole AgX grains was 0.91, the average aspect ratio (that is, the ratio of the average diameter to the average thickness) of the (100) tabular grains having an aspect ratio of at least 2 was 3.7, the average diameter of the (100) tabular grains having an aspect ratio of at least 2 was 0.75 μm, the ratio of the total projected area of the (100) tabular grains having an aspect ratio of at least 2 and an edge ratio of 1–4 to the total projected area of the whole AgX grains was 0,86, the variation coefficient relating to the diameter distribution was 0.055 among the grains chosen in a proportion of 70% out of the (100) tabular grains having an aspect ratio of at least 2 in order of dimension, and the average thickness was 0.21 μm.

The removal of water soluble salts was carried out using a flocculation method, and the resulting emulsion was warmed again up to 40° C., admixed with 7.5 g of gelatin, 0.6 g of phenoxyethanol and 0.2 g of sodium polystyrenesulfonate as a thickener, and further adjusted to pH 6.2 and pAg 7.8 by the addition of sodium hydroxide.

The thus prepared emulsion which was kept at 58° C. and agitated, and thereto were added successively $1\times10^{-5}$ mole/mole Ag of a thiosulfonic acid compound of the following formula (1) and a combination of $8\times10^{-4}$ mole/mole Ag of Sensitizing Dye I with $3\times10^{-6}$ mole/mole Ag of Sensitizing Dye II.

Thiosulfonic Acid Compound (1)

$C_2H_5SO_2SNa$

Sensitizing Dye I

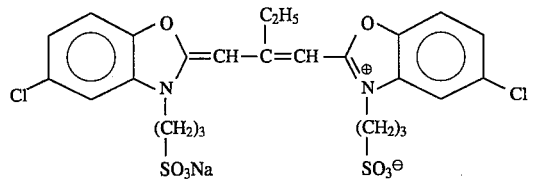

Sensitizing Dye II

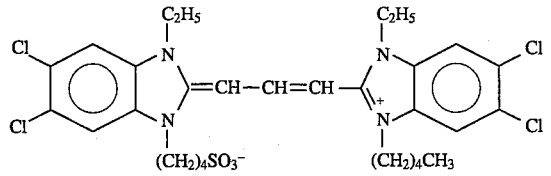

The resulting emulsion was chemically sensitized by the addition of sodium thiosulfate, a selenium compound I illustrated below, chloroauric acid and potassium thiosulfonate so that the optimum sensitivity might be achieved, and then cooled to 35° C. Thus, the present Emulsion A was prepared.

Selenium Compound I

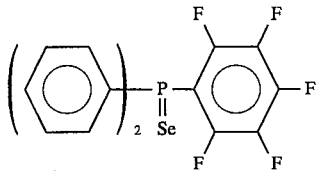

Preparation of Support X

[Preparation of Dye Dispersion A for Subbing Layer]

Dye I illustrated below was processed with a ball mill according to the method described in JP-A-63-197943.

Dye I

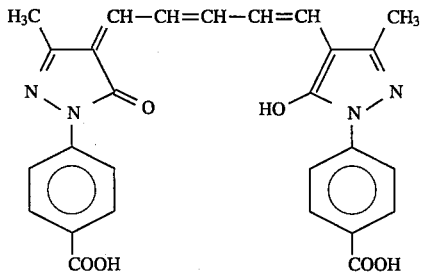

More specifically, 434 ml of water and 791 ml of a 6.7% aqueous solution of surfactant, Triton X-200, were placed in a 2-liter ball mill. Thereto, 20 g of Dye I and 400 ml of zirconium oxide beads (diameter: 2 mm) were added, and ground for 4 days. Then, 160 g of 12.5% gelatin was further added. After the defoaming, the zirconium oxide beads were removed by filtration. According to the microscopic observation, the thus obtained dye dispersion had a broad distribution with respect to the particle sizes of the ground dye. Specifically, the diameters of particles were in the range of 0.05 to 1.15 μm, and the average particle size was 0.37 μm.

Further, therefore, the dye particles having a diameter greater than 0.9 μm was removed by centrifugation.

Thus, the intended Dye Dispersion A was obtained.

[Preparation of Support X]

A 175 μm-thick, biaxially elongated, blue-colored polyethylene terephtalate film was subjected to a corona discharge treatment, and coated with a first subbing layer having the following composition by means of a wire bar coater so as to have a coverage of 4.9 cc/m$^2$, and dried at 185° C. for 1 minutes.

Then, the same subbing layer as the foregoing first subbing layer was formed on the other side of the film.

| Composition of First Subbing Layer | |
|---|---|
| Butadiene-styrene copolymer latex solution (proportion of solids: 40%, butadiene/styrene ratio: 31/69 by weight) | 158 cc |
| 4% Solution of 2,4-dichloro-6-hydroxy-s-triazine sodium salt | 41 cc |
| Distilled water | 300 cc |

Each of the first subbing layers provided on both sides of the film was coated at 185° C. with a second subbing layer having the following composition by means of a wire bar coater, and dried.

| Composition of Second Subbing Layer | |
|---|---|
| Gelatin | 160 mg/m$^2$ |
| Dye Dispersion A (on a solids basis) | 8 mg/m$^2$ |
| $C_{12}H_{23}O(CH_2CH_2O)_{10}H$ | 1.8 mg/m$^2$ |
| Proxel | 0.27 mg/m$^2$ |
| Matting agent (polymethylmethacrylate particles having an average size of 2.5 μm) | 2.5 g/m$^2$ |

Thus, the intended support provided with a crossover cut layer was prepared.

Preparation of Coating Composition for Emulsion Layer

A coating composition was prepared by adding to the tabular Emulsion A the following ingredients in the amounts set forth below per mole of silver halide:

| | |
|---|---|
| 2,6-Bis(hydroxyamino)-4-diethylamino-1,3,5-triazine | 72 mg |
| Dextran (average molecular weight: 3.9 × 10$^4$) | 18.5 g |
| Sodium polystyrenesulfonate (average molecular weight: 6.0 × 10$^5$) | 1.8 g |
| Gelatin | An amount to adjust the gelatin coverage of the resulting emulsion layer to 1.6 g/m$^2$ |
| Hardener [1,2-bis(vinylsulfonylacetamido)ethane] | 3.2 g |

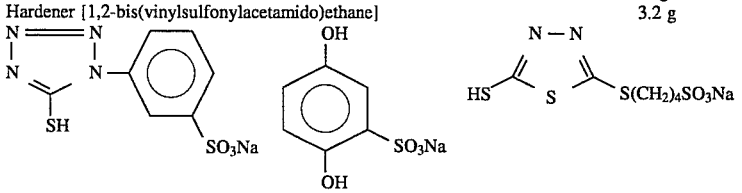

34 mg 34 mg 70 mg

The composition for a surface protecting layer was prepared so as to contain the following ingredients in amounts set forth below:

| | |
|---|---|
| Gelatin | 800 g |
| Dextran (average molecular weight: 3.9 × 10$^4$) | 200 g |
| $C_{16}H_{33}O(CH_2CH_2O)_{10}H$ | 39 g |
| $C_8F_{17}SO_2N(C_3H_7)(CH_2CH_2O)_4(CH_2)SO_3Na$ | 1.6 g |
| $C_8F_{17}SO_3K$ | 7 g |
| Polymethylmethacrylate particles (average size: 3.7 μm) | 91 g |
| Proxel | 0.7 g |
| Sodium polyacrylate (average molecular weight: 4.1 × 10$^4$) | 45 g |
| Sodium polystyrenesulfonate (average molecular weight: 6.0 × 10$^5$) | 3 g |
| NaOH | 1.6 g |
| $C_8H_{17}C_6H_4(OCH_2CH_2)_3SO_3Na$ | 24 g |

-continued

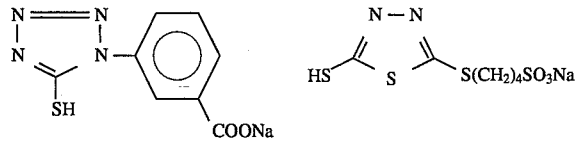

| | |
|---|---|
| 0.2 g | 0.05 mg |
| Distilled water to make | 14 l |

Preparation of Photographic Material

In accordance with simultaneous extrusion method, the previously prepared coating compositions for emulsion and surface protecting layers were applied to the front and back sides of the foregoing Support X successively. Therein, the gelatin coverage of the protecting layer was adjusted to 0.75 g/m$^2$, and the silver coverage, based on the tabular Emulsion A, was adjusted to 1.40 g/m$^2$ on one side of the support (2.8 g/m$^2$ on both sides). Thus, preparation of a photographic material was completed.

The photographic material obtained was examined for swelling percentage according to the means and definition described in JP-A-58-11193. The thus determined swelling percentage was 180%.

Further, the crossover light of the photographic material was determined to be 19% according to the means and definition described in U.S. Pat. Nos. 4,425,425 and 4,425,426.

| Preparation of Developer | |
|---|---|
| Potassium sulfite | 30.0 g |
| Potassium carbonate | 55.3 g |
| Diethylene glycol | 10.0 g |
| Diethylenetriaminepentaacetic acid | 2.0 g |
| Sodium bromide | 3.0 g |
| 5-Methylbenzotriazole | 0.1 g |
| 4-Hydroxymethyl-4-methyl-1-phenyl-3-pyrazolidone | 2.0 g |
| Compound of formula (A) set forth in Table 3 | 0.25 mole/l |
| Compound of formula (B) or (C) set forth in Table 3 | amount set forth in Table 3 |
| Water to make | 1 l |

The above composition was adjusted to pH 9.5 using sodium hydroxide.

Each of the foregoing developers in a volume of 1,000 ml was placed in a 2,000 ml beaker, and the beaker was covered with a wrapping film, Saran Wrap (trade name, a product of Asahi Chemical Industry Co., Ltd.), in which holes measuring 2 mm in diameter were made. Under this condition, the developer was allowed to stand for 7 days at room temperature to prepare the aged developer. As for the fixer, SR-F1 (trade name, products of Fuji Photo Film Co., Ltd.) was used. Photographic processing was performed with CEPROS-M (trade name, made by Fuji Photo Film Co., Ltd.), wherein the foregoing fresh and aged developers were used respectively, the development temperature and the fixation temperature were both set at 35° C. and the Dry-to-Dry processing time was controlled to 47 seconds.

In order to evaluate photographic properties, the photographic material was exposed to X-rays for 0.05 second on both sides through an X-ray orthoscreen, HR-4 (trade name, products of Fuji Photo Film Co., Ltd.), and subjected to the aforementioned photographic processing. The gradation was represented by the value obtained by subtracting the density fog +0.25 from the density fog +2.5 and then dividing the remainder by the value obtained by subtracting the logarithm of an exposure amount providing the density of 0.25 from the logarithm of an exposure amount providing the density of 2.5. The sensitivity was expressed in terms of the reciprocal of an exposure amount providing a density of 1.0. The sensitivities shown in Table 3 are relative values, with the photographic material processed with each fresh developer to which any of the present compounds was not added being taken as 100. The evaluation results are shown in Table 3.

TABLE 3

| No. | Compound of formula (A) added to Developer | Compound of Formula (B) or (C) added to Developer | Amount added (mole/l) | Developer used | Photographic Properties Sensitivity | Gradation | Note |
|---|---|---|---|---|---|---|---|
| 1 | A-1 | — | — | fresh | 100 | 2.7 | comparison |
| | | | | aged | 60 | 1.8 | |
| 2 | A-1 | $NH_2OH$ | 0.1 | fresh | 100 | 2.7 | comparison |
| | | | | aged | 59 | 1.7 | |
| 3 | A-1 | B-19 | 0.01 | fresh | 100 | 2.6 | invention |
| | | | | aged | 81 | 2.4 | |
| 4 | A-1 | B-19 | 0.05 | fresh | 100 | 2.6 | invention |
| | | | | aged | 83 | 2.4 | |
| 5 | A-1 | B-19 | 0.1 | fresh | 99 | 2.7 | invention |
| | | | | aged | 84 | 2.5 | |
| 6 | A-1 | B-19 | 0.5 | fresh | 100 | 2.7 | invention |
| | | | | aged | 90 | 2.6 | |
| 7 | A-1 | B-50 | 0.1 | fresh | 100 | 2.7 | invention |
| | | | | aged | 80 | 2.3 | |
| 8 | A-1 | C-9 | 0.1 | fresh | 99 | 2.7 | invention |

TABLE 3-continued

| No. | Compound of formula (A) added to Developer | Compound of Formula (B) or (C) added to Developer | Amount added (mole/l) | Developer used | Photographic Properties Sensitivity | Gradation | Note |
|---|---|---|---|---|---|---|---|
| | | | | aged | 82 | 2.4 | |
| 9 | A-6 | — | — | fresh | 100 | 2.7 | comparison |
| | | | | aged | 58 | 1.7 | |
| 10 | A-6 | $NH_2OH$ | 0.1 | fresh | 100 | 2.7 | comparison |
| | | | | aged | 58 | 1.8 | |
| 11 | A-6 | B-1 | 0.01 | fresh | 100 | 2.7 | invention |
| | | | | aged | 82 | 2.4 | |
| 12 | A-6 | B-1 | 0.05 | fresh | 100 | 2.7 | invention |
| | | | | aged | 84 | 2.5 | |
| 13 | A-6 | B-1 | 0.1 | fresh | 99 | 2.7 | invention |
| | | | | aged | 85 | 2.5 | |
| 14 | A-6 | B-1 | 0.5 | fresh | 100 | 2.7 | invention |
| | | | | aged | 86 | 2.6 | |
| 15 | A-6 | B-11 | 0.1 | fresh | 100 | 2.7 | invention |
| | | | | aged | 84 | 2.5 | |
| 16 | A-6 | C-19 | 0.1 | fresh | 99 | 2.7 | invention |
| | | | | aged | 82 | 2.4 | |
| 17 | A-17 | — | — | fresh | 99 | 2.7 | comparison |
| | | | | aged | 60 | 1.8 | |
| 18 | A-17 | B-23 | 0.01 | fresh | 100 | 2.7 | invention |
| | | | | aged | 80 | 2.4 | |
| 19 | A-17 | B-23 | 0.05 | fresh | 100 | 2.7 | invention |
| | | | | aged | 82 | 2.5 | |
| 20 | A-17 | B-23 | 0.1 | fresh | 100 | 2.7 | invention |
| | | | | aged | 85 | 2.6 | |
| 21 | A-17 | B-23 | 0.5 | fresh | 100 | 2.7 | invention |
| | | | | aged | 86 | 2.6 | |
| 22 | A-17 | B-26 | 0.1 | fresh | 100 | 2.7 | invention |
| | | | | aged | 83 | 2.5 | |
| 23 | A-17 | C-14 | 0.1 | fresh | 99 | 2.7 | invention |
| | | | | aged | 82 | 2.4 | |
| 24 | A-23 | — | — | fresh | 100 | 2.7 | comparison |
| | | | | aged | 62 | 1.9 | |
| 25 | A-23 | B-37 | 0.01 | fresh | 100 | 2.7 | invention |
| | | | | aged | 80 | 2.3 | |
| 26 | A-23 | B-37 | 0.05 | fresh | 99 | 2.6 | invention |
| | | | | aged | 82 | 2.4 | |
| 27 | A-23 | B-37 | 0.1 | fresh | 100 | 2.6 | invention |
| | | | | aged | 84 | 2.4 | |
| 28 | A-23 | B-37 | 0.5 | fresh | 100 | 2.7 | invention |
| | | | | aged | 85 | 2.5 | |
| 29 | A-23 | B-9 | 0.1 | fresh | 100 | 2.7 | invention |
| | | | | aged | 85 | 2.6 | |
| 30 | A-23 | C-21 | 0.1 | fresh | 100 | 2.7 | invention |
| | | | | aged | 82 | 2.5 | |
| 31 | A-39 | — | — | fresh | 100 | 2.7 | comparison |
| | | | | aged | 60 | 1.8 | |
| 32 | A-39 | B-9 | 0.01 | fresh | 100 | 2.7 | invention |
| | | | | aged | 80 | 2.3 | |
| 33 | A-39 | B-9 | 0.05 | fresh | 100 | 2.7 | invention |
| | | | | aged | 84 | 2.4 | |
| 34 | A-39 | B-9 | 0.1 | fresh | 99 | 2.6 | invention |
| | | | | aged | 86 | 2.5 | |
| 35 | A-39 | B-9 | 0.5 | fresh | 100 | 2.7 | invention |
| | | | | aged | 87 | 2.6 | |
| 36 | A-39 | B-21 | 0.1 | fresh | 99 | 2.7 | invention |
| | | | | aged | 84 | 2.5 | |
| 37 | A-39 | C-17 | 0.1 | fresh | 100 | 2.7 | invention |
| | | | | aged | 82 | 2.5 | |

As can be seen from Table 3, significant effects were accomplished when the present compounds were added in an amount of at least 0.01 mole/l, and even when the amount added was increased up to 0.5 mole/l changes caused in the photographic properties were only small.

By adding the present compounds of formula (B) or (C) to a black-and-white developer containing an ascorbic acid or its derivative represented by formula (A) as a developing agent, the developer can acquire greatly enhanced stability to air oxidation, and hardly causes the generation of black spots in the development-processed silver halide photographic materials.

What is claimed is:

1. A method of developing a silver halide photographic material to form an image, which comprises processing the silver halide photographic material with a developer which does not substantially contain a dihydroxybenzene developing agent, wherein the developer contains:

1) at least one compound represented by formula (B) or (C):

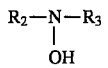

(B)

wherein $R_2$ and $R_3$ are the same or different, and each represents a hydrogen atom, an alkyl group, an aryl group or a heterocyclic group, excluding the case in which $R_2$ and $R_3$ are both a hydrogen atom; or $R_2$ and $R_3$ are linked to each other to form a heterocyclic ring together with the nitrogen atom;

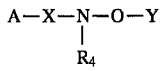

(C)

wherein A represents a hydrogen atom, an alkyl group, an aryl group, a heterocyclic group, an alkoxy group, an aryloxy group, an amino group, an alkylamino group, an acyl group, a carbamoyl group, a sulfamoyl group, a carboxyl group, a hydroxyamino group or a hydroxyaminocarbonyl group; X represents —C(=O)—, —C(=S)—, —$SO_2$— or —SO—; $R_4$ represents a hydrogen atom, an alkyl group or an aryl group; and Y represents a hydrogen atom or a group capable of being converted into a hydrogen atom by hydrolysis;

2) a developing agent represented by formula (A)

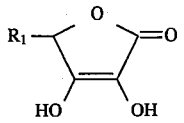

(A)

wherein $R_1$ represents a hydrogen atom, an alkyl group, an aryl group or a heterocyclic group;

3) a p-aminophenol developing agent and/or a 3-pyrazolidone developing agent; and 4) sulfite in an amount of at least 0.1 mole/l.

2. The method of developing a silver halide photographic material according to claim 1, wherein the compound represented by formula (A) is a compound represented by formula (D)

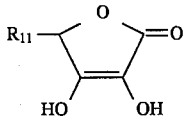

(D)

wherein $R_{11}$ is a group represented by formula (E) or (F);

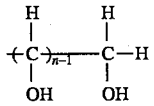

(E)

wherein n is an integer of 1 to 4;

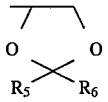

(F)

wherein $R_5$ and $R_6$ are the same or different, and each represents a hydrogen atom, an alkyl group, an aryl group or an alkenyl group, or alkyl groups represented by $R_5$ and $R_6$ are linked to each other to form a ring structure.

3. The method of developing a silver halide photographic material according to claim 1, wherein the developer contains the developing agent represented by formula (A) in an amount of 0.005 to 1 mole/l.

4. The method of developing a silver halide photographic material according to claim 1, wherein the developer contains the at least one compound represented by formula (B) or (C) in an amount of 0.005 to 2 mole/l.

5. The method of developing a silver halide photographic material according to claim 1, wherein the developer contains the p-aminophenol developing agent or the 3-pyrazolidone developing agent in an amount of 0.0005 to 0.2 mole/l.

6. The method of developing a silver halide photographic material according to claim 1, wherein the developer contains the sulfite in an amount of 0.1 to 2 mole/l.

7. The method of developing a silver halide photographic material according to claim 1, wherein the developer has a pH of 9 to 12.

8. The method of developing a silver halide photographic material according to claim 1, wherein the silver halide photographic material comprises a silver halide emulsion comprising tabular silver halide grains.

9. The method of developing a silver halide photographic material according to claim 1, wherein the developer contains a hydrazine nucleation agent.

10. The method of developing a silver halide photographic material according to claim 1, wherein the compound represented by formula (A) is a compound represented by formula (D)

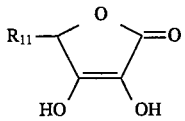

(D)

wherein $R_{11}$ is a group represented by formula (F)

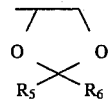

(F)

wherein $R_5$ and $R_6$ are the same or different, and each represents a hydrogen atom, an alkyl group, an aryl group or an alkenyl group, or alkyl groups represented by $R_5$ and $R_6$ are linked to each other to form a ring structure.

* * * * *